US011605903B2

(12) United States Patent
Watanabe et al.

(10) Patent No.: US 11,605,903 B2
(45) Date of Patent: Mar. 14, 2023

(54) ARRAY ANTENNA APPARATUS AND METHOD FOR MANUFACTURING ARRAY ANTENNA APPARATUS

(71) Applicant: Mitsubishi Electric Corporation, Chiyoda-ku (JP)

(72) Inventors: Hikaru Watanabe, Chiyoda-ku (JP); Takashi Maruyama, Chiyoda-ku (JP); Masataka Otsuka, Chiyoda-ku (JP); Yu Ushijima, Chiyoda-ku (JP); Kazunari Kihira, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 988 days.

(21) Appl. No.: 16/318,924

(22) PCT Filed: Aug. 10, 2016

(86) PCT No.: PCT/JP2016/073575
§ 371 (c)(1),
(2) Date: Jan. 18, 2019

(87) PCT Pub. No.: WO2018/029807
PCT Pub. Date: Feb. 15, 2018

(65) Prior Publication Data

US 2019/0260137 A1 Aug. 22, 2019

(51) Int. Cl.
*H01Q 21/00* (2006.01)
*H01Q 13/22* (2006.01)
(Continued)

(52) U.S. Cl.
CPC ..... *H01Q 21/005* (2013.01); *H01Q 5/42* (2015.01); *H01Q 13/22* (2013.01); *H01Q 21/24* (2013.01); *H01P 3/123* (2013.01)

(58) Field of Classification Search
CPC ..... H01Q 21/005; H01Q 5/42; H01Q 13/22; H01Q 21/24; H01P 3/123
See application file for complete search history.

(56) References Cited

U.S. PATENT DOCUMENTS 3,193,830 A 7/1965 Provencher
5,638,079 A 6/1997 Kastner et al.
(Continued)

FOREIGN PATENT DOCUMENTS

JP 53-47987 4/1978
JP 2-280504 A 11/1990
(Continued)

OTHER PUBLICATIONS

Extended European Search Report dated Jul. 22, 2019 in European Patent Application No. 16912688.5 citing documents AA-AD therein, 8 pages.
(Continued)

*Primary Examiner* — Hoang V Nguyen
(74) *Attorney, Agent, or Firm* — Oblon, McClelland, Maier & Neustadt, L.L.P.

(57) ABSTRACT

Waveguide slot array antennas each having slots, that transmit or receive electromagnetic waves and that are formed in a front surface of a waveguide and waveguide slot array antennas each having slots that transmit or receive electromagnetic waves and that are formed in a front surface of a waveguide, and the waveguide slot array antennas and the waveguide slot array antennas are alternately arranged, the waveguide is a ridge waveguide having a ridge formed inside the waveguide, and the waveguide is a ridge waveguide having ridges, formed inside the waveguide.

4 Claims, 13 Drawing Sheets

(51) Int. Cl.

| | |
|---|---|
| ***H01Q 21/24*** | (2006.01) |
| ***H01Q 5/42*** | (2015.01) |
| *H01P 3/123* | (2006.01) |

(56) References Cited

U.S. PATENT DOCUMENTS

| | | | | |
|---|---|---|---|---|
| 8,098,189 | B1 * | 1/2012 | Woodell | H01Q 1/281 342/26 R |
| 2004/0107910 | A1 * | 6/2004 | Nakata | H01J 37/32229 118/723 MW |
| 2015/0029069 | A1 * | 1/2015 | Roemer | H01Q 13/18 343/771 |
| 2015/0222014 | A1 | 8/2015 | Stevenson et al. | |
| 2015/0222021 | A1 * | 8/2015 | Stevenson | H01Q 21/005 343/771 |
| 2016/0028164 | A1 | 1/2016 | Watanabe et al. | |

FOREIGN PATENT DOCUMENTS

| | | | | |
|---|---|---|---|---|
| JP | 2003-318648 | A | 11/2003 | |
| JP | 2003318648 | A * | 11/2003 | H01Q 21/08 |
| JP | 2012-4700 | A | 1/2012 | |
| JP | 2012-204975 | A | 10/2012 | |
| WO | WO 2013/145842 | A1 | 10/2013 | |

OTHER PUBLICATIONS

International Search Report dated Nov. 1, 2016 in PCT/JP2016/073575 filed on Aug. 10, 2016.

Japanese Office Action dated Aug. 28, 2018 and Jan. 8, 2019 in Japanese Patent Application No. 2018-533360 (with English language translation), citing documents AR, AS and AT therein.

Hu, A. Y. et al., "Rectangular-Ridge Waveguide Slot Array," IRE Transactions on Antennas and Propagation, Jan. 1961, pp. 102-105.

* cited by examiner (Front)

(Back)

(Front)

(Back)

(Front)

ARRAY ANTENNA APPARATUS AND METHOD FOR MANUFACTURING ARRAY ANTENNA APPARATUS

TECHNICAL FIELD

The present disclosure relates to an array antenna apparatus having slots for transmitting or receiving electromagnetic waves formed in front surfaces of waveguides, and to a method for manufacturing the array antenna apparatus.

BACKGROUND ART

Array antenna apparatuses having slots for transmitting or receiving electromagnetic waves formed in a front surface of a waveguide are known as a low-loss antenna for use, for example, in wireless communication.

Patent Literature 1 below discloses an array antenna apparatus capable of transmitting or receiving two orthogonal polarization signals.

The array antenna apparatus disclosed in Patent Literature 1 includes a plurality of first antennas each having a plurality of slots whose longitudinal direction is in the waveguide axial direction of a first waveguide and which are formed in a front surface of the first waveguide; and a plurality of second antennas each having a plurality of slots whose longitudinal direction is in the waveguide width direction of a second waveguide and which are formed in a front surface of the second waveguide, and the first antennas and the second antennas are alternately arranged.

Electromagnetic waves transmitted and received by the first antennas are horizontal polarization, and electromagnetic waves transmitted or received by the second antennas are vertical polarization.

CITATION LIST

Patent Literatures

Patent Literature 1: JP 2003-318648 A

SUMMARY OF INVENTION

Technical Problem

The first waveguides of the first antennas and the second waveguides of the second antennas are rectangular waveguides in which a cross-sectional shape of a cavity, or the inside, is a rectangle.

The cross-sectional shape of the cavity of each of the first waveguides has a longitudinal direction in a waveguide width direction and has a transverse direction in a height direction, and the cross-sectional shape of the cavity of each of the second waveguides has a longitudinal direction in a height direction and has a transverse direction in a waveguide width direction.

Hence, depending on the wavelength of an electromagnetic wave to be transmitted or received, the waveguide width of the first waveguides is wide and the waveguide height of the second waveguides is high. As a result, there is a problem in that the outer dimensions of the entire array antenna apparatus needs to be large.

Note that in the case in which the waveguide width of the first waveguides is wide, the spacing between the plurality of first antennas may be one or more wavelengths of electromagnetic waves to be transmitted or received by the first antennas. Likewise, the spacing between the plurality of second antennas may be one or more wavelengths of electromagnetic waves to be transmitted or received by the second antennas. If the spacing between the first antennas or the spacing between the second antennas is one or more wavelengths of electromagnetic waves to be transmitted or received, grating lobes which are radiation of electromagnetic waves in undesired directions occur.

Embodiments in this disclosure are made to solve the problem described above, and an object of the embodiments is to obtain an array antenna apparatus with smaller overall outer dimensions than one in which waveguides are rectangular waveguides.

Moreover, an object of embodiments is to obtain a method for manufacturing the above-described array antenna apparatus.

Solution to Problem

An array antenna apparatus according to the disclosure includes: a first antenna including a first waveguide with a first slot for transmitting or receiving an electromagnetic wave, the first slot being formed in a front surface of the first waveguide; and a second antenna including a second waveguide with a second slot for transmitting or receiving an electromagnetic wave, the second slot being formed in a front surface of the second waveguide, wherein the first antenna and the second antenna are alternately arranged, the first waveguide is a ridge waveguide having a first protrusion formed inside, and the second waveguide is a ridge waveguide having a second protrusion formed inside.

Advantageous Effects of Invention

According to an aspect of embodiments, an array antenna apparatus includes a first and second waveguides, wherein the first waveguide is a ridge waveguide having a first protrusion formed inside the first waveguide, and the second waveguide is a ridge waveguide having a second protrusion formed inside the second waveguide. Therefore, there is provided an advantageous effect of being able to obtain an array antenna apparatus with smaller overall outer dimensions than one in which the first and second waveguides are rectangular waveguides.

DESCRIPTION OF EMBODIMENTS

To describe the present invention in more detail, embodiments for carrying out the invention will be described below with reference to the accompanying drawings.

Embodiment 1.

Figure 1:
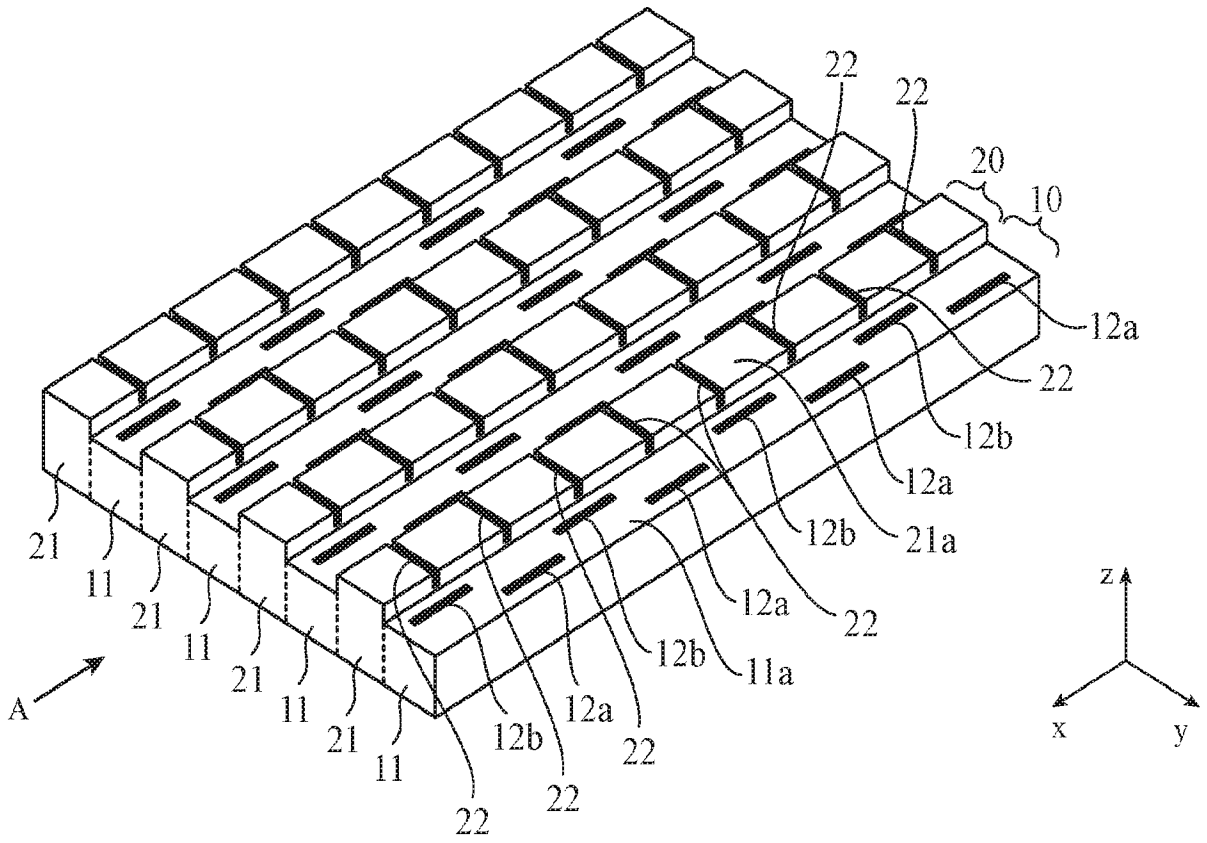
FIG. 1 is a perspective view showing an array antenna apparatus according to Embodiment 1 of this disclosure.
Figure 2:
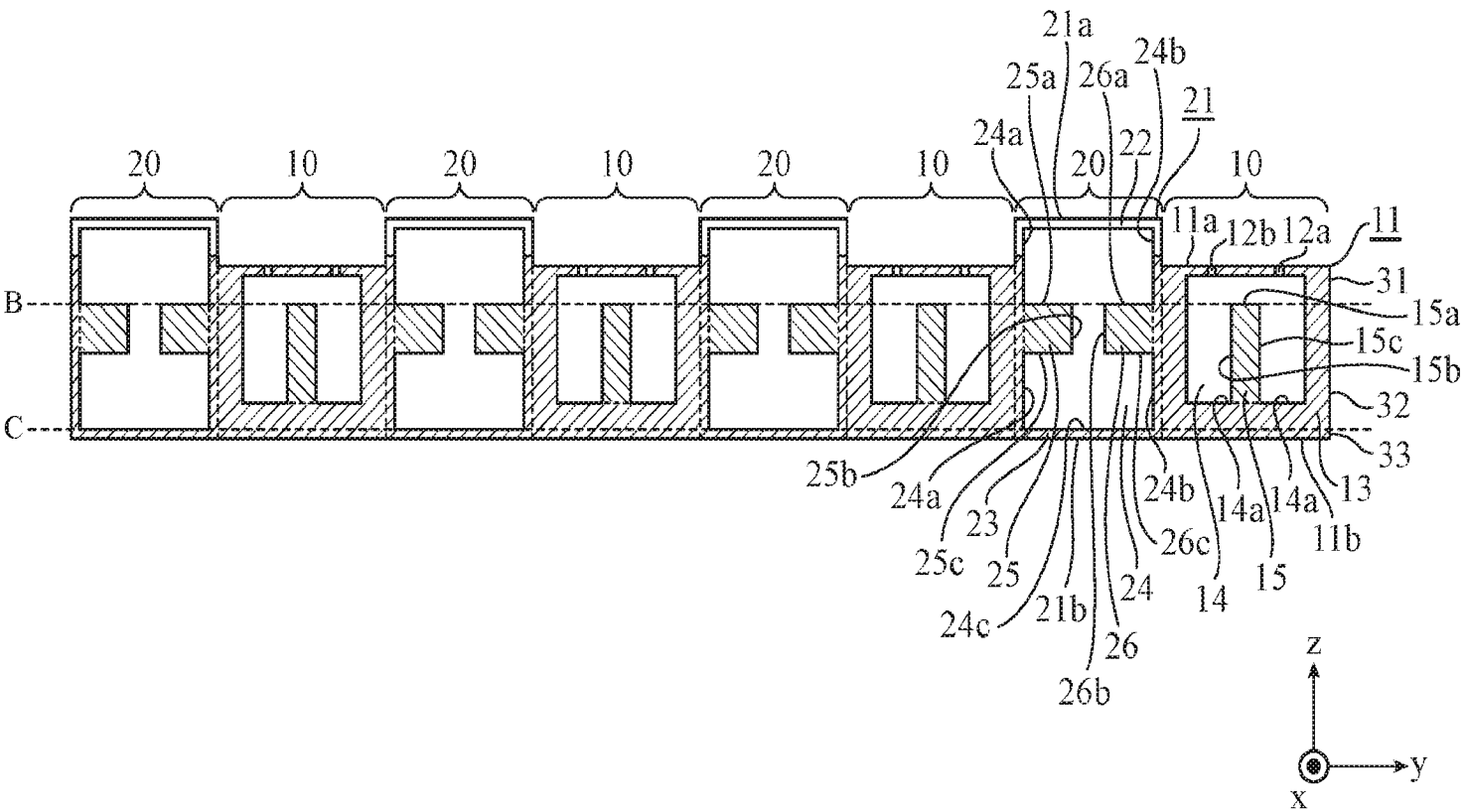
FIG. 2 is a cross-sectional transparent view showing the array antenna apparatus as viewed from A of FIG. 1.

FIG. 1 is a perspective view showing an array antenna apparatus according to Embodiment 1 of the disclosure, and FIG. 2 is a cross-sectional transparent view showing the array antenna apparatus as viewed from A of FIG. 1.

In FIGS. 1 and 2, the x-direction is a waveguide axial direction of waveguide slot array antennas 10 and 20, the y-direction is a waveguide width direction of the waveguide slot array antennas 10 and 20, and the z-direction is a height direction of the waveguide slot array antennas 10 and 20.

The waveguide slot array antennas 10 and the waveguide slot array antennas 20 are alternately arranged in the y-direction.

The waveguide slot array antennas 10 are first antennas each having slots 12*a* and 12*b* for transmitting or receiving signals (electromagnetic waves) with co-polarization in the y-direction formed in a front surface 11*a* of a waveguide 11.

The waveguide 11 which is a first waveguide has an outer wall 13 which is made of a conductor such as a metal, and has a cavity 14 which is the inside and is, for example, a hollow or dielectric insulator.

Note that, for the outer wall 13 of the waveguide 11, aluminum is commonly used, but any other metals than aluminum may be used as long as it works as a conductor for the radio frequencies of signals to be transmitted and received.

The slots 12*a* and 12*b* which are first slots are openings provided in the front surface 11*a* of the waveguide to transmit or receive signals with co-polarization in the y-direction, and the longitudinal direction of the openings is in the x-direction.

In Embodiment 1, the slots 12*a* and the slots 12*b* are offset from each other in the y-direction.

This is because if the slots 12*a* and the slots 12*b* are arranged in a straight line, co-polarized waves transmitted or received from the slots 12*a* and co-polarized waves transmitted or received from the slots 12*b* may cancel each other out.

A ridge 15 is a first protrusion extending from a bottom 14*a* of the cavity 14 of the waveguide 11 toward the front surface 11*a* of the waveguide 11.

Thus, the waveguide 11 of the waveguide slot array antenna 10 is a ridge waveguide having the first protrusion formed within the waveguide.

The waveguide slot array antennas 20 are second antennas each having slots 22 for transmitting or receiving signals (electromagnetic waves) with co-polarization in the x-direction formed in a front surface 21*a* of a waveguide 21.

The waveguide 21 which is a second waveguide has an outer wall 23 which is a conductor such as a metal, and has a cavity 24 which is the inside and is, for example, a hollow or dielectric insulator.

Note that, for the outer wall 23 of the waveguide 21, aluminum is commonly used, but any other metals than aluminum may be used as long as it works as a conductor for the radio frequencies of signals to be transmitted and received.

The slots 22 which are second slots are openings provided in the front surface 21*a* of the waveguide 21 to transmit or receive signals with co-polarization in the x-direction, and the longitudinal direction of the openings is in the y-direction.

A ridge 25 is a second protrusion extending from one side part 24*a* toward another side part 24*b* in the cavity 24 of the waveguide 21.

A ridge 26 is a second protrusion extending from the side part 24*b* toward the side part 24*a* in the cavity 24 of the waveguide 21.

Thus, the waveguide 21 of the waveguide slot array antenna 20 is a ridge waveguide having the second protrusions formed within the waveguide.

In Embodiment 1, of a plurality of planes 15*a*, 15*b*, and 15*c* of the ridge 15 formed in the waveguide 11, the plane 15*a* parallel to the front surface 11*a* of the waveguide 11, of a plurality of planes 25*a*, 25*b*, and 25*c* of the ridge 25 formed in the waveguide 21, the plane 25*a* parallel to the front surface 21*a* of the waveguide 21, and of a plurality of planes 26*a*, 26*b*, and 26*c* of the ridge 26 formed in the waveguide 21, the plane 26*a* parallel to the front surface 21*a* of the waveguide 21 are in the same plane.

Namely, the plane 15*a* of the ridge 15 and the planes 25*a* and 26*a* of the ridges 25 and 26 are in a plane indicated as B in FIG. 2.

Note that because the planes 25*c* and 26*c* of the ridges 25 and 26 are also planes parallel to the front surface 21*a* of the waveguide 21, the planes 25*c* and 26*c* may be in the plane indicated by B of FIG. 2. However, in Embodiment 1, the planes 25*a* and 26*a* are in the plane indicated as B in FIG. 2 because processing of a first member 31, which will be described later, is easier with the planes 25*a* and 26*a* being in the plane indicated as B in FIG. 2.

In addition, in Embodiment 1, the distance between the bottom 14*a* defining the cavity 14 in the waveguide 11 and a back surface 11*b* of the waveguide 11 is longer than the distance between a bottom 24*c* defining the cavity 24 of the waveguide 21 and a back surface 21*b* of the waveguide 21.

Namely, the bottom 14*a* defining the cavity 14 of the waveguide 11 is provided in a more +z-direction position than the bottom 24*c* defining the cavity 24 of the waveguide 21.

The first member 31 is a member on the +z-side relative to the plane indicated as B in FIG. 2 (hereinafter, referred to as "division plane B") among a plurality of members forming the array antenna apparatus.

A second member 32 is a member on the −z-side relative to the division plane B among the plurality of members forming the array antenna apparatus, and on the +z-side relative to a plane indicated as C in FIG. 2 (hereinafter, referred to as "division plane C").

A third member 33 is a member on the −z-side relative to the division plane C among the plurality of members forming the array antenna apparatus.

In array antenna apparatuses, because the upper limit of overall gain is directly proportional to an area, in order to obtain a high-gain antenna, a large number of waveguide slot array antennas 10 and 20 need to be arranged.

Hence, for example, an embodiment is conceivable in which ten waveguide slot array antennas 10 and ten waveguide slot array antennas 20 are arranged.

For simplification of the drawings, FIGS. 1 and 2 show an example in which four waveguide slot array antennas 10 and four waveguide slot array antennas 20 are arranged.

Next, its functioning will be described.

In the case in which the waveguide slot array antennas 10 and 20 are used as transmit antennas that transmit signals, signals to be transmitted are inputted, for example, from ends in the +x-direction or −x-direction of the waveguides 11 and 21.

The signals having been inputted from the ends in the +x-direction or −x-direction of the waveguides 11 and 21 propagate in the cavities 14 and 24 within the waveguides 11 and 21.

The signals having propagated in the cavity 14 in the waveguide 11 are radiated toward the outside through the slots 12*a* and 12*b* formed in the front surface 11*a* of the waveguide 11, as signals with co-polarization in the y-direction.

The signals having propagated in the cavity 24 in the waveguide 21 are radiated toward the outside through the slots 22 formed in the front surface 21*a* of the waveguide 21, as signals with co-polarization in the x-direction.

In the case in which the waveguide slot array antennas 10 and 20 are used as receive antennas that receive signals, signals having arrived from the outside and having co-polarization in the y-direction enters through the slots 12*a* and 12*b* formed in the front surface 11*a* of the waveguide 11.

On the other hand, signals having arrived from the outside and having co-polarization in the x-direction enters through the slots 22 formed in the front surface 21*a* of the waveguide 21.

The signals having entered through the slots 12*a* and 12*b* propagate in the cavity 14 in the waveguide 11 and are outputted, for example, from the end in the +x-direction or −x-direction of the waveguide 11.

The signals having entered through the slots 22 propagate in the cavity 24 in the waveguide 21 and are outputted, for example, from the end in the +x-direction or −x-direction of the waveguide 21.

Although here an example is shown in which signals are inputted and outputted from the end in the +x-direction or −x-direction of the waveguides 11 and 21 of the waveguide slot array antennas 10 and 20, for example, signals may be inputted from or outputted to a waveguide connected to the bottoms of the waveguides 11 and 21.

The waveguide slot array antennas 10 and 20 may produce grating lobes, which are radiation of electromagnetic waves in undesired directions, when radiating signals to the outside.

Specifically, the waveguide slot array antennas 10 produce grating lobes if the spacing between the waveguide slot array antennas 10 is one or more wavelengths of a signal whose co-polarization is in the y-direction.

Also, the waveguide slot array antennas 20 produce grating lobes if the spacing between the waveguide slot array antennas 20 is one or more wavelengths of a signal whose co-polarization is in the x-direction.

Hence, to suppress grating lobes to be produced by the waveguide slot array antennas 10, the spacing between the waveguide slot array antennas 10 needs to be less than one wavelength of a signal whose co-polarization is in the y-direction.

Moreover, to suppress grating lobes to be produced by the waveguide slot array antennas 20, the spacing between the waveguide slot array antennas 20 needs to be less than one wavelength of a signal whose co-polarization is in the x-direction.

To set the spacing between the waveguide slot array antennas 10 and the spacing between the waveguide slot array antennas 20 to less than one wavelength of a signal, the dimension in the y-direction, which are the waveguide widths of the waveguides 11 and 21 of the waveguide slot array antennas 10 and 20, needs to be reduced.

Figure 3A:
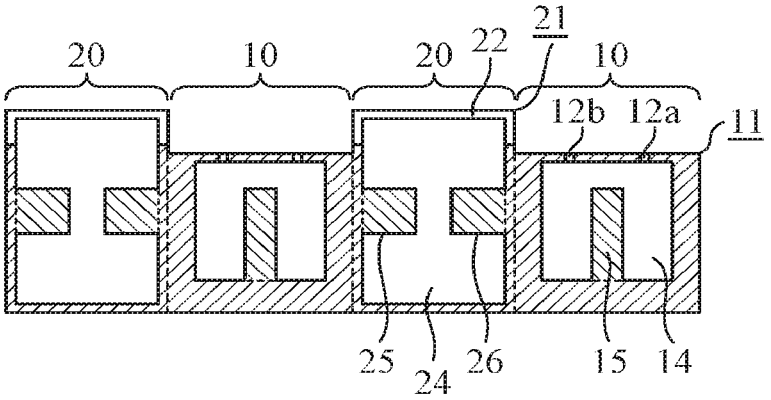
FIG. 3A is an illustrative diagram showing the dimensions in the y-direction and z-direction of waveguides 11 and 21 in a case in which a ridge 15 is provided inside the waveguide 11 and ridges 25 and 26 are provided inside the waveguide 21.

Here, FIG. 3A is an illustrative diagram showing the dimensions in the y-direction and z-direction of waveguides 11 and 21 in a case in which a ridge 15 is provided inside the waveguide 11 and ridges 25 and 26 are provided inside the waveguide 21.

Figure 3B:
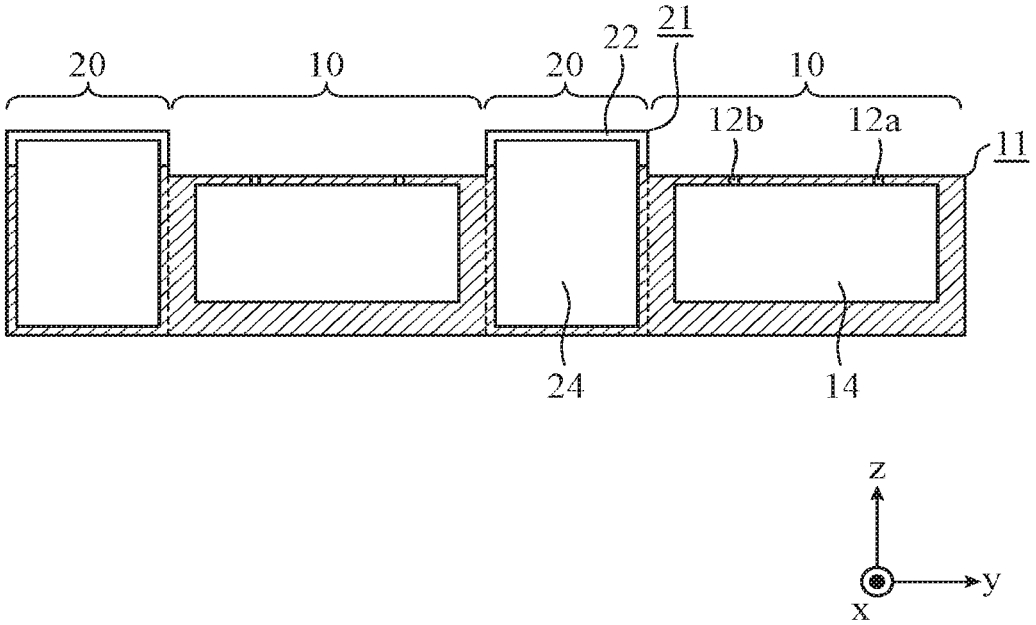
FIG. 3B is an illustrative diagram showing the dimensions in the y-direction and z-direction of waveguides 11 and 21 in a case in which a ridge 15 is not provided inside the waveguide 11 and ridges 25 and 26 are not provided inside the waveguide 21.

FIG. 3B is an illustrative diagram showing the dimensions in the y-direction and z-direction of the waveguides 11 and 21 in a case in which the ridge 15 is not provided inside the waveguide 11 and the ridges 25 and 26 are not provided inside the waveguide 21.

FIGS. 3A and 3B show examples in which, for simplification of the drawings, two waveguide slot array antennas 10 and two waveguide slot array antennas 20 are arranged.

The waveguides 11 and 21 are ridge waveguides in Embodiment 1, while the waveguide that is not provided with the ridge 15 or the ridges 25 and 26 inside the waveguide is described as a rectangular waveguide in the following.

The slots 12*a* and 12*b* whose longitudinal directions are the x-direction are formed in the front surface 11*a* of the waveguide 11 of the waveguide slot array antenna 10 so as to transmit or receive signals whose co-polarization is in the y-direction.

Hence, if the waveguide 11 is a rectangular waveguide, as shown in FIG. 3B, the cross-sectional shape of the cavity 14 of the waveguide 11 is a rectangle whose longitudinal direction is the y-direction and whose transverse direction is the z-direction.

Here, it is known that the waveguide 11 which is a ridge waveguide has a lower cutoff frequency of a signal to be transmitted or received than a rectangular waveguide.

Therefore, in the waveguide 11 which is a ridge waveguide, as shown in FIGS. 3A and 3B, the dimension in the y-direction of the cavity 14 can be reduced compared to a rectangular waveguide. When the dimension in the y-direction of the cavity 14 can be reduced, the dimension in the y-direction which is the waveguide width of the waveguide 11 can be reduced.

By the reduction in the dimension in the y-direction of the waveguides 11, the spacing between the waveguide slot array antennas 10 is less than one wavelength of a signal whose co-polarization is in the y-direction in some cases.

In these cases, the occurrence of grating lobes from the waveguide slot array antennas 10 can be suppressed.

Moreover, by the reduction in the dimension in the y-direction of the waveguides 11, the spacing between the waveguide slot array antennas 20 is less than one wavelength of a signal whose co-polarization is in the x-direction in some cases.

In these cases, the occurrence of grating lobes from the waveguide slot array antennas 20 can be suppressed.

Note, however, that even if the dimension in the y-direction of the waveguides 11 is reduced, the spacing between the waveguide slot array antennas 10 is one or more wavelengths of a signal whose co-polarization is in the y-direction depending on the wavelength of a signal whose co-polarization is in the y-direction.

In this case, the occurrence of grating lobes from the waveguide slot array antennas 10 cannot be suppressed.

Also, even if the dimension in the y-direction of the waveguides 11 is reduced, the spacing between the waveguide slot array antennas 20 is one or more wavelengths of a signal whose co-polarization is in the x-direction depending on the wavelength of a signal whose co-polarization is in the x-direction.

In this case, the occurrence of grating lobes from the waveguide slot array antennas 20 cannot be suppressed.

Even so, in the waveguide 11 which is a ridge waveguide, since the dimension in the y-direction of the cavity 14 can be reduced compared to a rectangular waveguide, the amount of grating lobes occurred can be reduced over a rectangular waveguide.

In addition, in the waveguide 11 which is a ridge waveguide, by changing the shape or size of the ridge 15, the amount of reduction in cutoff frequency changes.

Hence, in the waveguide 11 which is a ridge waveguide, by changing the shape or size of the ridge 15, the spacing between the waveguide slot array antennas 10 can be made less than one wavelength of a signal whose co-polarization is in the y-direction. In addition, when the spacing between the waveguide slot array antennas 10 can be made less than one wavelength of a signal whose co-polarization is in the y-direction, as a result, the spacing between the waveguide slot array antennas 20 can also be made less than one wavelength of a signal whose co-polarization is in the x-direction.

When the spacing between the waveguide slot array antennas 10 can be made less than one wavelength of a signal whose co-polarization is in the y-direction, a signal whose co-polarization is in the y-direction can be suppressed from being radiated in undesired directions.

In addition, when the spacing between the waveguide slot array antennas 20 can be made less than one wavelength of a signal whose co-polarization is in the x-direction, a signal whose co-polarization is in the x-direction can be suppressed from being radiated in undesired directions.

The slots 22 whose longitudinal direction is the y-direction are formed in the front surface 21*a* of the waveguide 21 of the waveguide slot array antenna 20 so as to transmit or receive signals whose co-polarization is in the x-direction.

Hence, if the waveguide 21 is a rectangular waveguide, as shown in FIG. 3B, the cross-sectional shape of the cavity 24 of the waveguide 21 is a rectangle whose longitudinal direction is the z-direction and whose transverse direction is the y-direction.

Here, it is known that the waveguide 21 which is a ridge waveguide has a lower cutoff frequency of a signal to be transmitted or received than a rectangular waveguide.

Therefore, in the waveguide 21 which is a ridge waveguide, as shown in FIGS. 3A and 3B, the dimension in the z-direction of the cavity 24 can be reduced compared to a rectangular waveguide. When the dimension in the z-direction of the cavity 24 can be reduced, the dimension in the z-direction which is the waveguide height of the waveguide 21 can be reduced.

By the reduction in the dimension in the z-direction of the waveguides 21, the dimension in the z-direction of the array antenna apparatus is reduced, enabling reduction of the thickness of the array antenna apparatus.

Although in the example of FIGS. 2 and 3 the two ridges 25 and 26 are symmetrically provided to improve the symmetry of a structure in the y-direction of the waveguide 21, only one of the ridges 25 and 26 may be provided.

In Embodiment 1, the dimension in the y-direction of the waveguide 21 of the waveguide slot array antenna 20 is designed to be less than or equal to half of the guided wavelength so as not to allow electromagnetic waves of undesired modes to propagate.

On the other hand, the dimension in the longitudinal direction of the slots 22 is designed to be approximately half of the free space wavelength.

Because of this, both ends in the longitudinal direction of the slot 22 are bent in the z-direction, and the dimension in the y-direction of the slot 22 is less than or equal to half.

Therefore, the dimension in the z-direction of both end regions of the slot 22 increases as the dimension in the y-direction of the waveguide 21 decreases.

As the dimension in the z-direction of the slots 22 increases, the difference in level between the front surface 11*a* of the waveguide 11 of the waveguide slot array antenna 10 and the front surface 21*a* of the waveguide 21 of the waveguide slot array antenna 20 increases. Therefore, time and trouble in processing the front surfaces 11*a* and 21*a* is increased.

Thus, it is desirable that the dimension in the y-direction of the cavities 24 of the waveguides 21 be somewhat shorter than the dimension of half of the free space wavelength.

The longitudinal directions of the slots 12*a* and 12*b* are the x-direction, and by changing the positions in the y-direction of the slots 12*a* and 12*b* formed in the front surface 11*a* of the waveguide 11, the impedance matching of the waveguide slot array antenna 10 can be adjusted.

Note, however, that when the position in the z-direction of the plane 15*a* of the ridge 15 is low due to the short dimension in the z-direction of the ridge 15, an electrical change in the waveguide 11 caused by a positional change in the y-direction of the slots 12*a* and 12*b* is small. Hence, even if the positions in the y-direction of the slots 12*a* and 12*b* are changed, the impedance matching of the waveguide slot array antenna 10 may not be able to be adjusted.

Therefore, it is desirable that the position in the z-direction of the plane 15*a* be close to the top of the cavity 14 of the waveguide 11 by setting the position in the z-direction to high by increasing the dimension in the z-direction of the ridge 15 as much as possible.

The electrical characteristics of the waveguide 21 do not greatly change even if the dimensions in the z-direction of the ridges 25 and 26 are changed. Hence, in Embodiment 1, in order to disturb an electromagnetic field in the cavity 24, as shown in FIG. 5, the cavity 24 is provided with irises 40. Details of the irises 40 will be described later.

When the dimensions in the z-direction of the ridges and 26 are increased, the ridges 25 and 26 may come close to or come into contact with the irises 40. By the ridges 25 and 26 coming close to or coming into contact with the irises 40, the characteristics of the waveguide slot array antenna 20 may degrade.

In addition, when the dimensions in the z-direction of the ridges 25 and 26 are increased, the weight of the waveguide slot array antenna 20 increases.

Therefore, it is desirable that the positions in the z-direction of the planes 25*a* and 26*a* of the ridges 25 and 26 be low by reducing the dimensions in the z-direction of the ridges 25 and 26 as much as possible.

Hence, it is conceivable that the position in the z-direction of the plane 15*a* of the ridge 15 is designed to be close to the top of the cavity 14 of the waveguide 11, and the positions in the z-direction of the planes 25*a* and 26*a* of the ridges 25 and 26 are designed to be as low as possible.

As an example of the design, Embodiment 1 shows an example in which the plane 15*a* of the ridge 15 and the planes 25*a* and 26*a* of the ridges 25 and 26 are in the same plane.

As is clear from the above, according to Embodiment 1, it is configured such that there are provided the waveguide slot array antennas 10 each having the slots 12*a* and 12*b* that transmit or receive electromagnetic waves and that are formed in the front surface 11*a* of the waveguide 11 and the waveguide slot array antennas 20 each having slots 22 that transmit or receive electromagnetic waves and that are formed in the front surface 21*a* of the waveguide 21, and the waveguide slot array antennas 10 and the waveguide slot array antennas 20 are alternately arranged, the waveguide 11 is a ridge waveguide having a ridge 15 formed inside the waveguide, and the waveguide 21 is a ridge waveguide having ridges 25 and 26 formed inside the waveguide, and thus, an advantageous effect is provided that an array antenna apparatus with smaller overall outer dimensions than one in which the waveguides 11 and 21 are rectangular waveguides can be obtained.

Note that when, by a reduction in the dimension in the y-direction of the waveguides 11, the spacing between the waveguide slot array antennas 10 is less than one wavelength of a signal whose co-polarization is in the y-direction and the spacing between the waveguide slot array antennas 20 is less than one wavelength of a signal whose co-polarization is in the x-direction, the occurrence of grating lobes can be suppressed.

A method for manufacturing the array antenna apparatus of Embodiment 1 will be described below.

Figure 4:
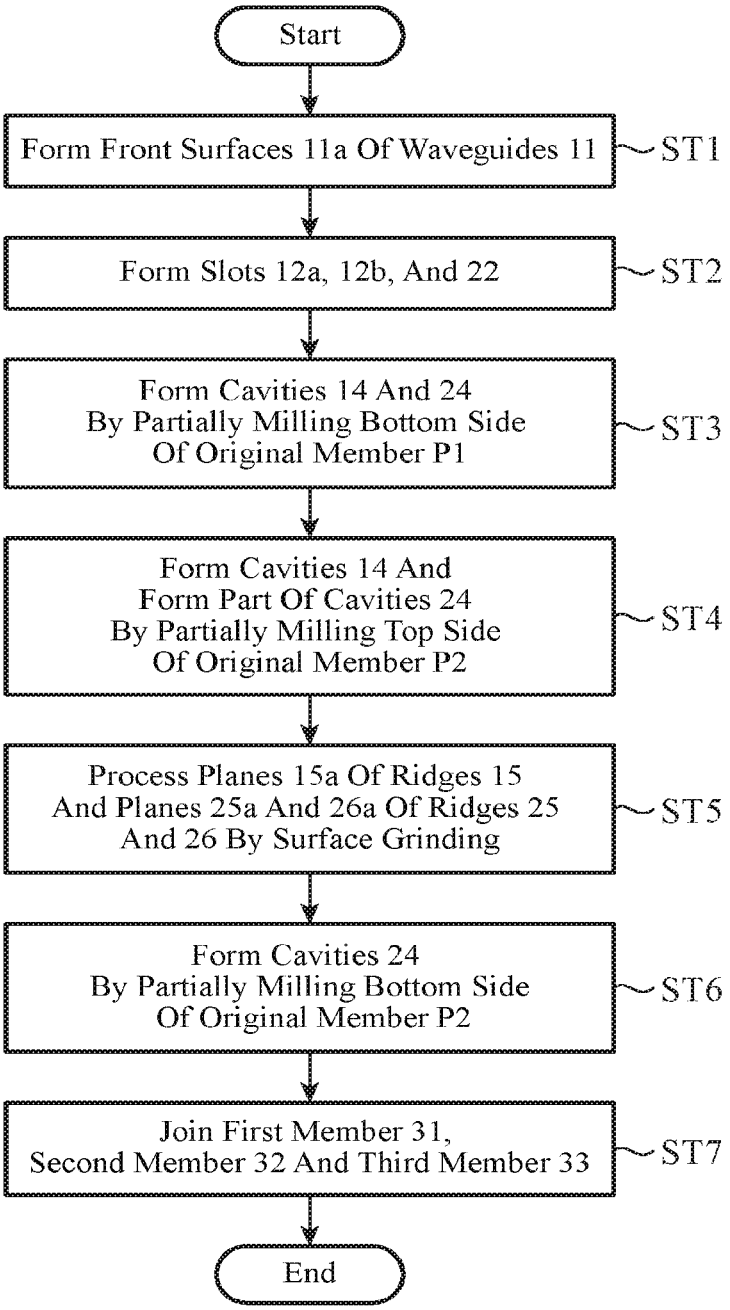
FIG. 4 is a flowchart showing a method for manufacturing the array antenna apparatus according to Embodiment 1 of this disclosure.

FIG. 4 is a flowchart showing a method for manufacturing the array antenna apparatus according to Embodiment 1 of the disclosure.

As shown in FIG. 2, the array antenna apparatus includes the first member 31, the second member 32, and the third member 33.

In Embodiment 1, it is assumed that the array antenna apparatus is manufactured by processing each of the first member 31, the second member 32, and the third member 33 into shapes shown in FIG. 2, and then joining together the first member 31, the second member 32, and the third member 33.

Figure 5A:
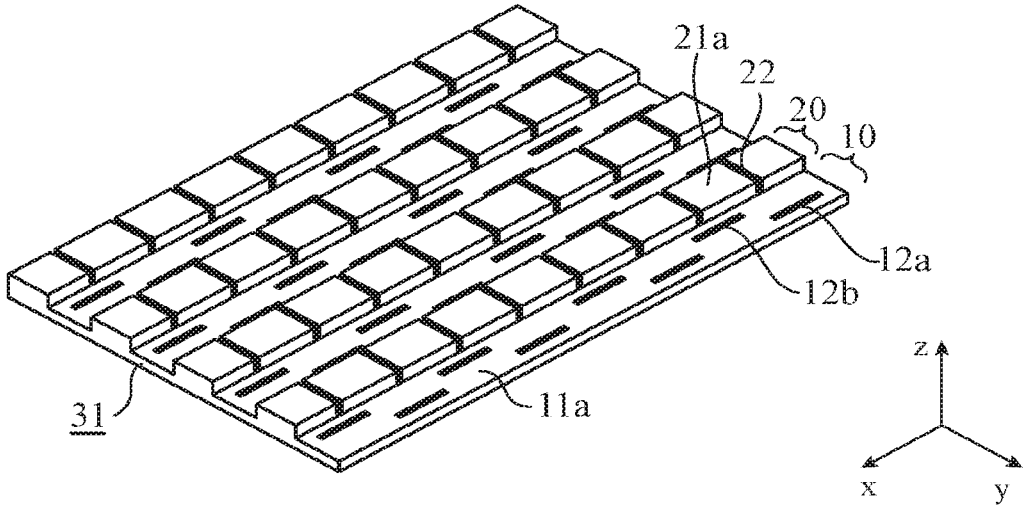
FIG. 5A is a perspective view in which a front-surface side of a first member 31 can be seen.
Figure 5B:
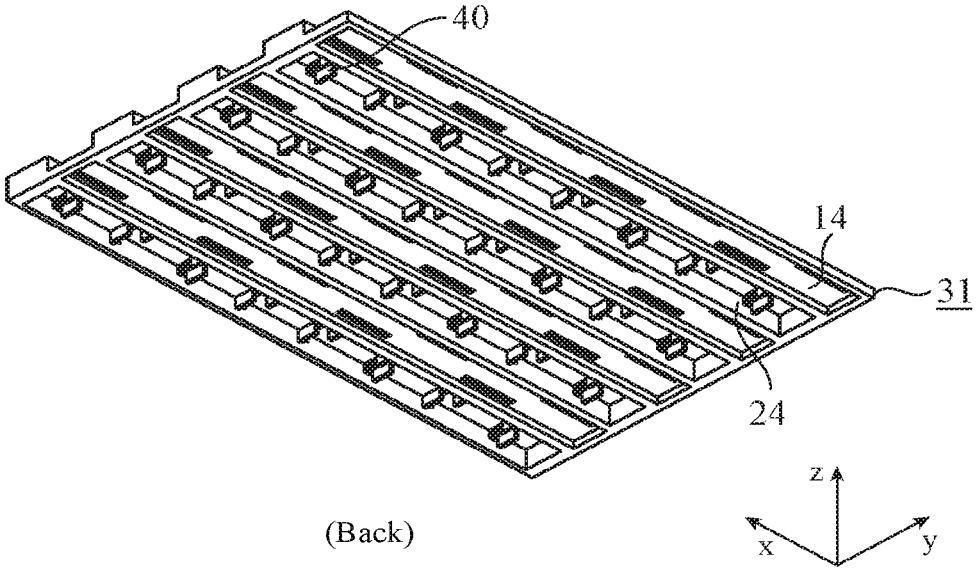
FIG. 5B is a perspective view in which a back-surface side of the first member 31 can be seen.

FIGS. 5A and 5B are perspective views showing the first member 31 of the array antenna apparatus.

FIG. 5A shows a front-surface side of the first member 31, and FIG. 5B shows a back side surface of the first member 31.

The front surface of the first member 31 is a top surface of the first member 31 in FIG. 2, and the back surface of the first member 31 is a bottom surface of the first member 31 in FIG. 2.

As shown in FIG. 5B, the cavities 24 of the waveguides 21 of the first member 31 are provided with irises 40.

In FIGS. 2 and 3, depiction of the irises 40 is omitted for the sake of brevity.

The irises 40 are metal plates for disturbing an electromagnetic field in the cavities 24 to radiate a signal whose co-polarization is in the x-direction through the slots 22.

In the example of FIG. 5, the square irises 40 are provided in positions sandwiching the slots 22, i.e., a position shifted by several millimeters in the +x-direction from each slot 22 and a position shifted by several millimeters in the −x-direction from the slot 22. Note, however, that the shape and number of irises 40 provided in the cavities 24 of the waveguides 21 may be any as long as a signal whose co-polarization is in the x-direction can be radiated through the slots 22.

In addition, although in the example of FIG. 5 the irises 40 are provided in the cavities 24 of the waveguides 21, the configuration is not limited to one provided with the irises 40 as long as a signal whose co-polarization is in the x-direction can be radiated through the slots 22. Therefore, for example, conductors may be inserted in the cavities 24 of the waveguides 21.

Figure 6A:
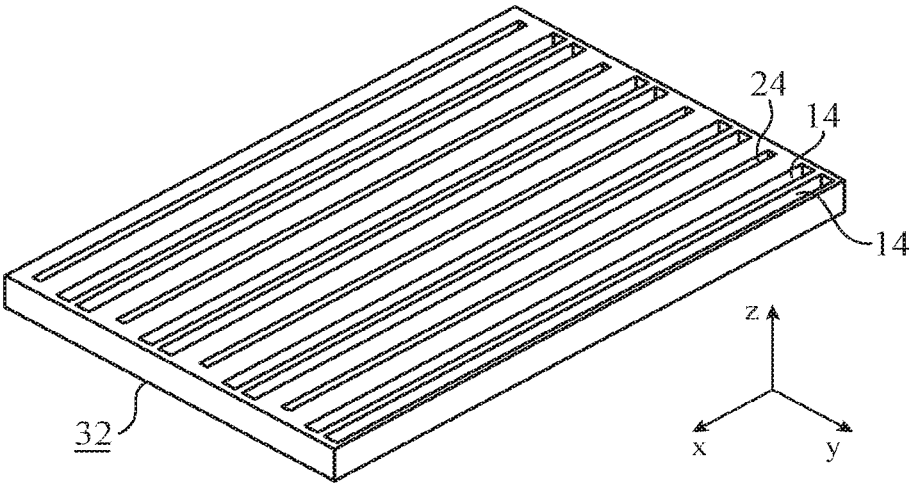
FIG. 6A is a perspective view in which a front-surface side of a second member 32 can be seen.
Figure 6B:
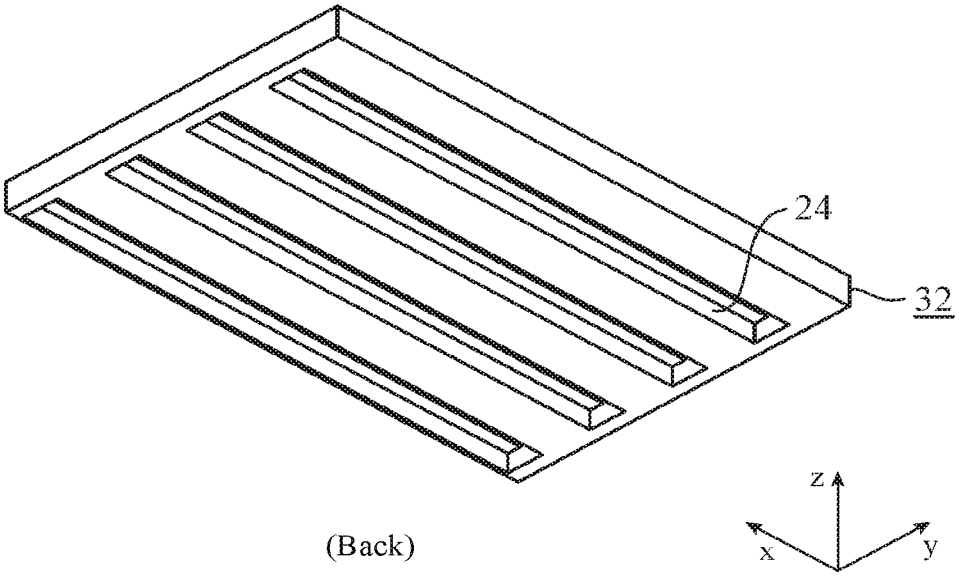
FIG. 6B is a perspective view in which a back-surface side of the second member 32 can be seen.

FIGS. 6A and 6B are perspective views showing the second member 32 of the array antenna apparatus.

FIG. 6A shows a front-surface side of the second member 32, and FIG. 6B shows a back-surface side of the second member 32.

Figure 7:
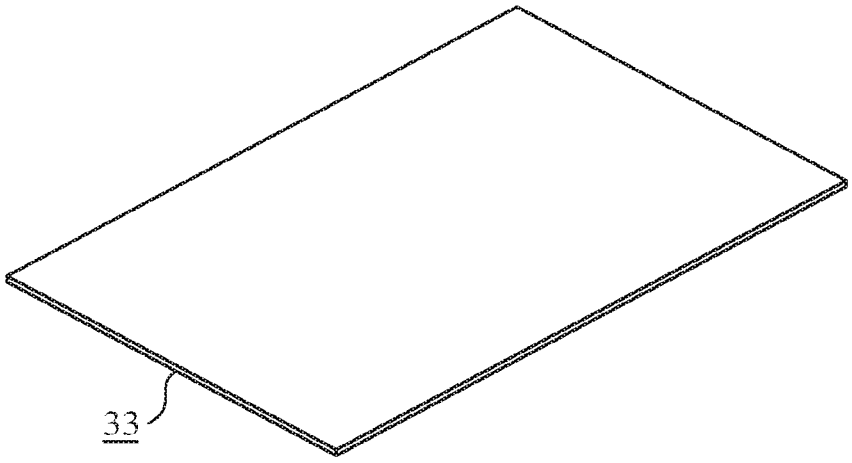
FIG. 7 is a perspective view showing a third member 33 of the array antenna apparatus.

FIG. 7 is a perspective view showing the third member 33 of the array antenna apparatus. FIG. 7 shows a front-surface side of the third member 33. The third member 33 is a flat board.

The front surface of the second member 32 is a top surface of the second member 32 in FIG. 2, and the back surface of the second member 32 is a bottom surface of the second member 32 in FIG. 2.

In addition, the front surface of the third member 33 is a top surface of the third member 33 in FIG. 2.

Processing of the first member 31 will be described.

The front surface of the first member 31 has portions recessed in the −z-direction with reference to the front surfaces 21*a* of the waveguides 21. Namely, the front surfaces 11*a* of the waveguides 11 are recessed in the −z-direction relative to the front surfaces 21*a* of the waveguides 21.

Hence, for example, if a member processed into the first member 31 is a flat board (hereinafter, referred to as "original member P1"), by partially milling a top side of the original member P1 as shown in FIG. 2, the front surfaces 11*a* of waveguides 11 are formed (step ST1 of FIG. 4).

Then, by performing groove processing in which linear grooves whose longitudinal direction is the x-direction are made, on the front surfaces 11*a* of the waveguides 11, the slots 12*a* and 12*b* are formed (step ST2 of FIG. 4).

In addition, by performing groove processing in which linear grooves whose longitudinal direction is the y-direction are made, on the front surfaces 21*a* of the waveguides 21, the slots 22 are formed (step ST2 of FIG. 4).

The back surface of the first member 31 is provided with the cavities 14 and the cavities 24 and thus has portions recessed in the +z-direction with reference to the division plane B.

Hence, by partially milling a bottom side of the original member P1 as shown in FIG. 2, the cavities 14 of the waveguides 11 and the cavities 24 of the waveguides 21 are formed (step ST3 of FIG. 4). Here, an example is shown in which the cavities 14 of the waveguides 11 and the cavities 24 of the waveguides 21 are hollow insulators.

Note, however, that when irises 40 are to be provided in the cavities 24 of the waveguides 21, in forming the cavities 24 of the waveguides 21 by partially milling the bottom side of the original member P1, the bottom side of the original member P1 is cut such that the irises 40 remain, as shown in FIG. 5B.

Although here an example is shown in which processing of the front-surface side of the first member 31 is performed and then processing of the back-surface side of the first member 31 is performed, processing of the back-surface side of the first member 31 may be performed and then processing of the front-surface side of the first member 31 may be performed.

Processing of the second member 32 will be described.

Figure 8:
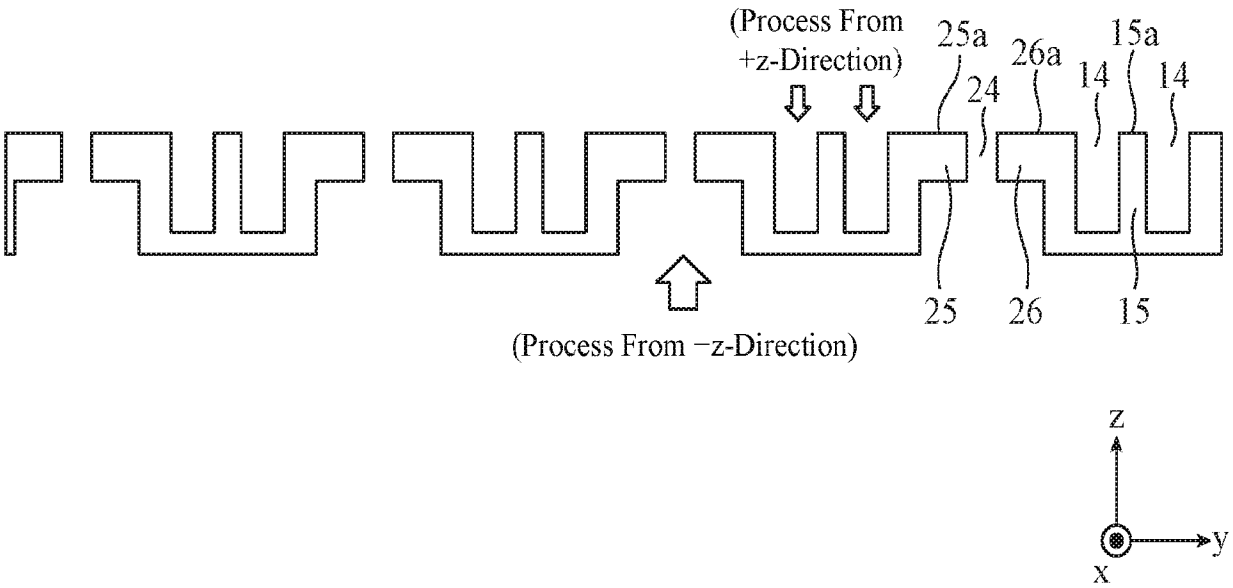
FIG. 8 is an illustrative diagram showing a method for processing the second member 32.

FIG. 8 is an illustrative diagram showing a method for processing the second member 32.

The front surface of the second member 32 is provided with the cavities 14 and the cavities 24 and thus has portions recessed in the −z-direction with reference to the division plane B.

Hence, for example, if a member processed into the second member 32 is a flat board (hereinafter, referred to as "original member P2"), by partially milling a top side of the original member P2 as shown in FIG. 2, the cavities 14 of the waveguides 11 are formed and part of the cavities 24 of the waveguides 21 is formed (step ST4 of FIG. 4).

In the example of FIG. 2, the cross-sectional shape of the cavities 24 of the waveguides 21 is such a shape that the alphabet "H" is turned sideways.

Hence, the cross-sectional shape of the cavities 24 of the second member 32 is such a shape that a lower rectangular portion with a wide width in the y-direction and an upper rectangular portion with a narrow width in the y-direction are stacked on top of each other.

Processing of the upper rectangular portions with a narrow width in the y-direction in the cavities 24 can be easily performed by milling from the front-surface side of the second member 32, but processing of the lower rectangular portions with a wide width in the y-direction in the cavities 24 is more easily performed by milling from the back-surface side of the second member 32 than by milling from the front-surface side of the second member 32.

Hence, at step ST4, only processing of the upper rectangular portions with a narrow width in the y-direction in the cavities 24 is performed.

Then, by performing surface grinding processing in which a plane is ground, on the top side of the original member P2 whose top side has been partially cut, the planes 15*a* of ridges 15 and the planes 25*a* and 26*a* of the ridges 25 and 26 are processed (step ST5 of FIG. 4).

Because in the surface grinding processing a surface grinding machine with a large processing area and the like can be used, the planes 15*a* of the ridges 15 and the planes 25*a* and 26*a* of the ridges 25 and 26 can be easily processed.

Namely, by using a surface grinding machine with a large processing area and the like, the planes 15*a* of the ridges 15 and the planes 25*a* and 26*a* of the ridges 25 and can be simultaneously processed, and thus, processing time can be reduced.

Because the back surface of the second member 32 is to be provided with the cavities 24 of the waveguides 21, there is provided portions recessed in the +z-direction with reference to the division plane C.

Hence, by partially milling a bottom side of the original member P2 as shown in FIG. 2, the cavities 24 of the waveguides 21 are formed (step ST6 of FIG. 4).

Since processing of the upper rectangular portions with a narrow width in the y-direction in the cavities 24 has already been performed, at step ST6 only processing of the lower rectangular portions with a wide width in the y-direction in the cavities 24 is performed.

Although here an example is shown in which processing of the front-surface side of the second member 32 is performed and then processing of the back-surface side of the second member 32 is performed, processing of the back-surface side of the second member 32 may be performed and then processing of the front-surface side of the second member 32 may be performed.

In addition, although here an example is shown in which processing of the first member 31 is performed and then processing of the second member 32 is performed, processing of the second member 32 may be performed and then processing of the first member 31 may be performed.

After the first member 31 and the second member 32 has been processed, the first member 31 and the second member 32 are joined together, and the second member 32 and the third member 33 are joined together (step ST7 of FIG. 4).

For a method for joining together the first member 31 and the second member 32 and a method for joining together the second member 32 and the third member 33, for example, a method for bonding using a conductive adhesive is considered.

There is only one joint surface between the first member 31 and the second member 32, and there is only one joint surface between the second member 32 and the third member 33.

Hence, when the first member 31 to the third member 33 are joined together using a conductive adhesive, only by applying pressure to the first member 31 to the third member 33 in one direction, i.e., the z-direction, the first member 31 to the third member 33 can be joined together.

Although here a method for joining together the first member 31 to the third member 33 using a conductive adhesive is shown, the method is not limited to one using a conductive adhesive and, for example, the first member 31 to the third member 33 may be joined together by a method such as diffusion bonding, brazing, or screwing. Even in a case of joining by screwing, by performing screwing in which a screw is inserted in the z-direction, conduction between the first member 31 to the third member 33 can be obtained.

Embodiment 1 shows that the division plane B between the first member 31 and the second member 32 is the planes 15*a* of the ridges 15 of the waveguides 11 and the planes 25*a* and 26*a* of the ridges 25 and 26 of the waveguides 21. This facilitates processing of the back-surface side of the first member 31 and facilitates processing of the front-surface side of the second member 32.

In addition, Embodiment 1 shows that the division plane C between the second member 32 and the third member 33 is in the position of the bottoms 24*c* of the cavities 24 of the waveguides 21. This facilitates processing of the back-surface side of the second member 32.

Figure 9:
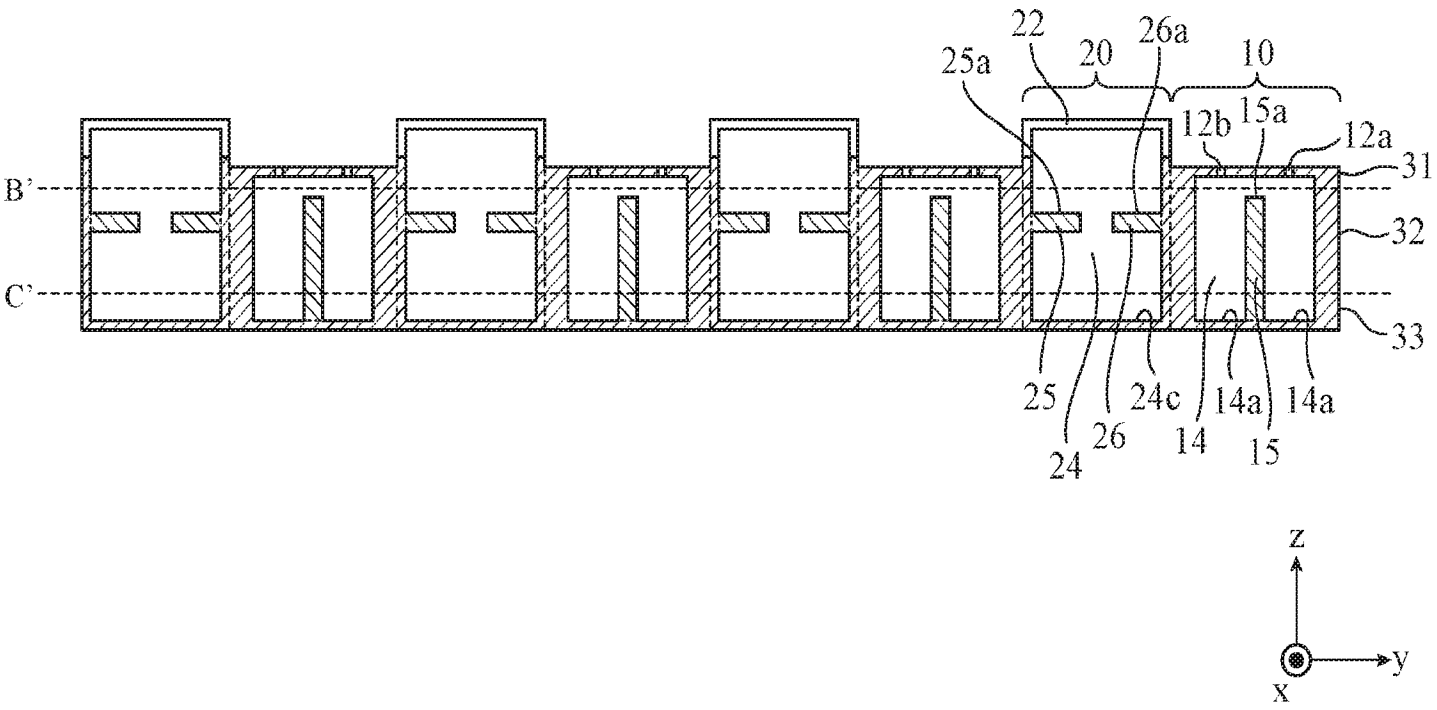
FIG. 9 is a cross-sectional transparent view showing an array antenna apparatus for a case in which a division plane B' between a first member 31 and a second member 32 is more in the +z-direction than planes 15*a* of ridges 15 of waveguides 11 and planes 25*a* and 26*a* of ridges 25 and 26 of waveguides 21, and a division plane C' between the second member 32 and a third member 33 is more in the +z-direction than bottoms 14*a* of cavities 14 of the waveguides 11 and bottoms 24*c* of cavities 24 of the waveguides 21.

Here, FIG. 9 is a cross-sectional transparent view showing an array antenna apparatus for a case in which a division plane B' between the first member 31 and the second member 32 is more in the +z-direction than the planes 15*a* of the ridges 15 of the waveguides 11 and the planes 25*a* and 26*a* of the ridges 25 and 26 of the waveguides 21, and a division plane C' between the second member 32 and the third member 33 is more in the +z-direction than the bottoms 14*a* of the cavities 14 of the waveguides 11 and the bottoms 24*c* of the cavities 24 of the waveguides 21.

When the division planes of the array antenna apparatus are the division planes B' and C', the number of protrusions and recesses on the front-surface side and back-surface side of the second member 32 increases over a case in which the division planes of the array antenna apparatus are the division planes B and C. In addition, protrusions and recesses are present on the front-surface side of the third member 33.

Hence, when the division planes of the array antenna apparatus are the division planes B' and C', time and trouble for milling processing performed on the second member 32 increase over a case in which the division planes of the array antenna apparatus are the division planes B and C. In addition, milling processing on the third member 33 is also required.

Namely, time and trouble for milling processing performed on the second member 32 and the third member 33 increase over a case in which, as in Embodiment 1, the division plane B between the first member 31 and the second member 32 is the planes 15*a* of the ridges 15 of the waveguides 11 and the planes 25*a* and 26*a* of the ridges 25 and 26 of the waveguides 21, and the division plane C between the second member 32 and the third member 33 is in the position of the bottoms 24*c* of the cavities 24 of the waveguides 21.

Although Embodiment 1 shows an example in which the division plane B between the first member 31 and the second member 32 is the planes 15*a* of the ridges 15 of the waveguides 11, if the division plane B is more in the −z-direction than the planes 15*a* of the ridges 15 of the waveguides 11, then the ridges 15 are separated into the first member 31 and the second member 32.

Hence, when the division plane B is more in the −z-direction than the planes 15*a* of the ridges 15 of the waveguides 11, upon joining together the first member 31 and the second member 32, the joining needs to be performed such that the separated ridges 15 are not misaligned.

Therefore, since the number of joint surfaces increases over a case in which the division plane B between the first member 31 and the second member 32 is the planes 15*a* of the ridges 15 of the waveguides 11, a joining process becomes troublesome and there is a possibility of degradation in joint accuracy. As a result, a reduction in yield due to joint failure is assumed.

As is clear from the above, according to Embodiment 1, it is configured such that upon manufacturing an array antenna apparatus in which the planes 15*a* of the ridges 15 of the waveguides 11 and the planes 25*a* and 26*a* of the ridges 25 and 26 of the waveguides 21 are in the same plane, the array antenna apparatus is manufactured by joining together the first member 31 and the second member 32 into which the array antenna apparatus is divided in the z-direction, and the division plane B between the first member 31 and the second member 32 is the planes 15*a* of the ridges 15 of the waveguides 11 and the planes 25*a* and 26*a* of the ridges 25 and 26 of the waveguides 21, and thus, the array antenna apparatus can be easily manufactured and a reduction in yield due to joint failure can be prevented.

Although Embodiment 1 shows that the division plane C between the second member 32 and the third member 33 is the bottoms 24*c* of the cavities 24 of the waveguides 21, the division plane C between the second member 32 and the third member 33 may be the bottoms 14*a* of the cavities 14 of the waveguides 11.

In addition, the division plane C between the second member 32 and the third member 33 may be in a position between the bottoms 14*a* of the cavities 14 of the waveguides 11 and the bottoms 24*c* of the cavities 24 of the waveguides 21.

In addition, although Embodiment 1 shows that the bottoms 14*a* of the cavities 14 of the waveguides 11 are provided in a position more in the +z-direction than the bottoms 24*c* of the cavities 24 of the waveguides 21, the bottoms 14*a* of the cavities 14 of the waveguides 11 may be provided in a position more in the −z-direction than the bottoms 24*c* of the cavities 24 of the waveguides 21.

Embodiment 2

The above-described Embodiment 1 describes the array antenna apparatus including the waveguide slot array antennas 10 that transmit or receive signals whose co-polarization is in the y-direction; and the waveguide slot array antennas 20 that transmit or receive signals whose co-polarization is in the x-direction.

This Embodiment 2 describes an array antenna apparatus including waveguide slot array antennas 10 that transmit or receive signals whose co-polarization is in the y-direction; and waveguide slot array antenna 50 that transmit or receive signals whose co-polarization is in the y-direction.

Figure 10:
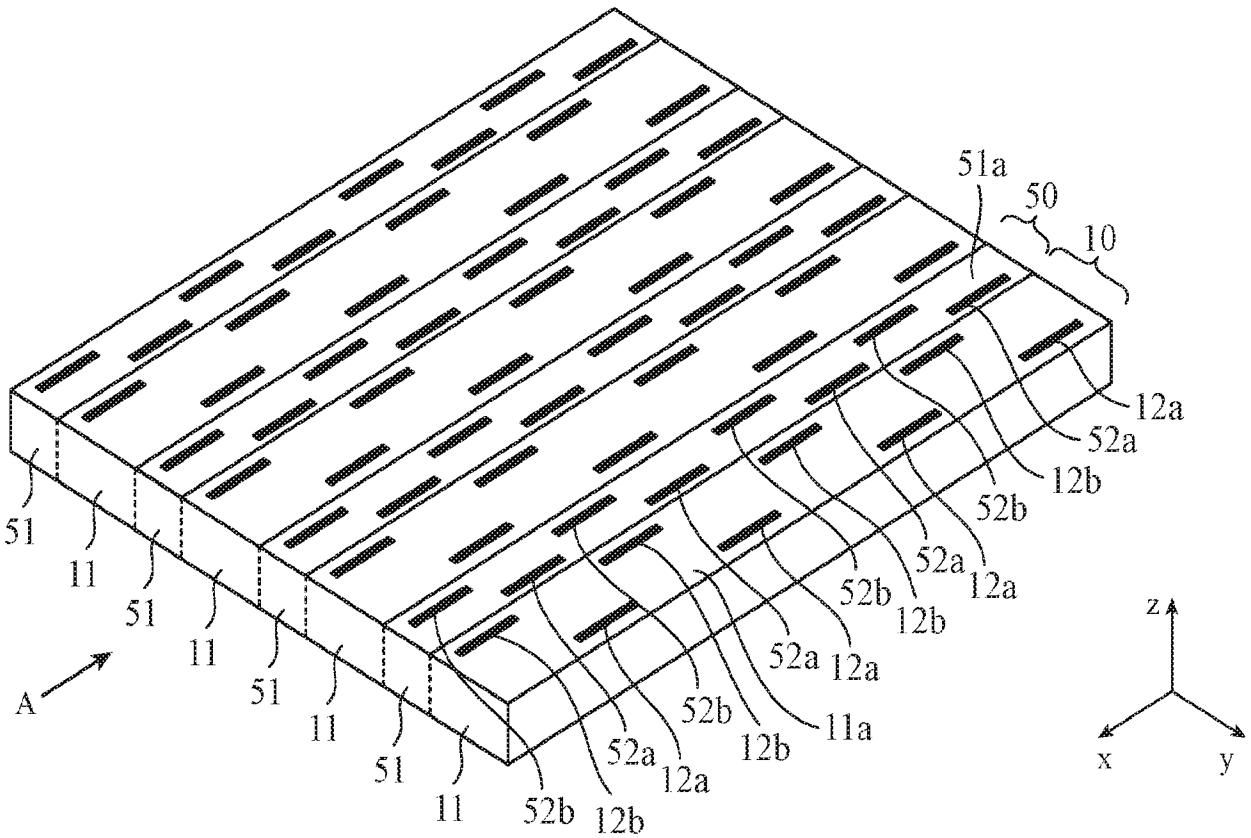
FIG. 10 is a perspective view showing an array antenna apparatus according to Embodiment 2 of this disclosure.
Figure 11:
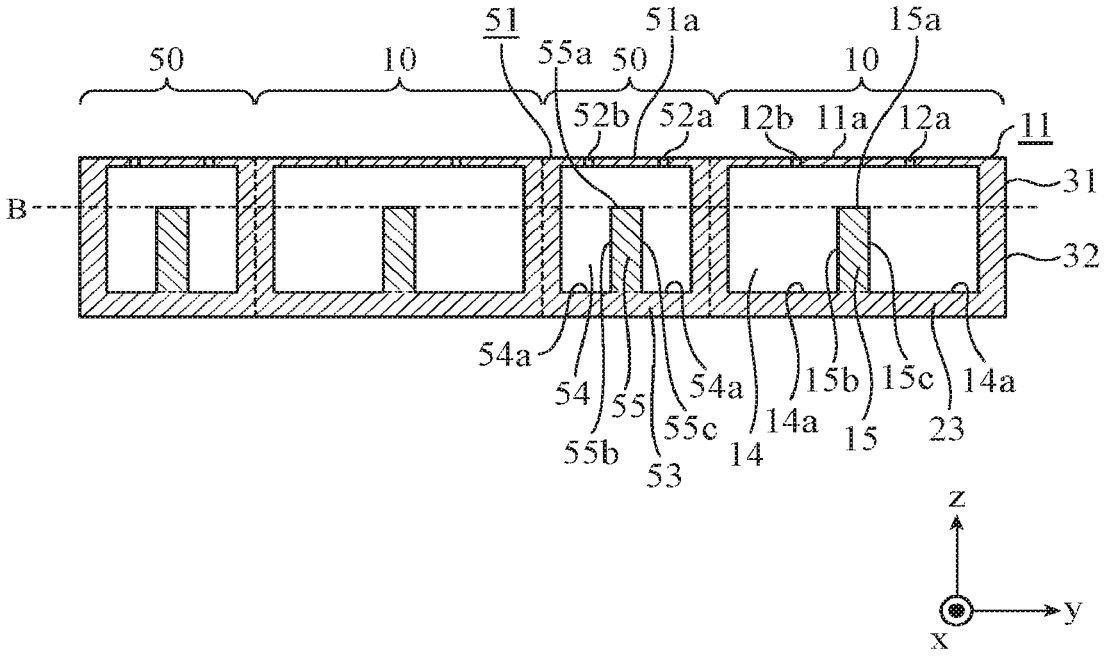
FIG. 11 is a cross-sectional transparent view showing the array antenna apparatus as viewed from A of FIG. 10.

FIG. 10 is a perspective view showing an array antenna apparatus according to Embodiment 2 of the disclosure, and FIG. 11 is a cross-sectional transparent view showing the array antenna apparatus as viewed from A of FIG. 10.

In FIGS. 10 and 11, the same reference signs as those of FIGS. 1 and 2 denote the same or corresponding portions and thus description thereof is omitted.

FIG. 11 shows an example in which, for simplification of the drawing, two waveguide slot array antennas 10 and two waveguide slot array antenna 50 are arranged.

The waveguide slot array antenna 50 are second antennas each having slots 52*a* and 52*b* that transmit or receive signals (electromagnetic waves) whose co-polarization is in the y-direction and that are formed in a front surface 51*a* of a waveguide 51.

The waveguide 51 which is a second waveguide has an outer wall 53 which is a conductor such as a metal, and has a cavity 54 which is the inside and is, for example, a hollow or dielectric insulator.

Note that, for the outer wall 53 of the waveguide 51, aluminum is commonly used, but any other metals than aluminum, and the like, may be used as long as it works as a conductor for the radio frequencies of signals to be transmitted or received.

The slots 52*a* and 52*b* which are second slots are openings provided in the front surface 51*a* of the waveguide 51 to transmit or receive signals whose co-polarization is in the y-direction, and a longitudinal direction of the openings is the x-direction.

In Embodiment 2, the slots 52*a* and the slots 52*b* are arranged so as to be shifted relative to each other in the y-direction.

This is because when the slots 52*a* and the slots 52*b* are arranged in a straight line, the co-polarization transmitted or received by the slots 52*a* and the co-polarization transmitted or received by the slots 52*b* may cancel each other out.

A ridge 55 is a second protrusion extending from a bottom 54*a* of the cavity 54 of the waveguide 51 to the side of the front surface 51*a* of the waveguide 51.

Therefore, the waveguide 51 of the waveguide slot array antenna 50 is a ridge waveguide having the second protrusion formed inside the waveguide.

In Embodiment 2, of a plurality of planes 15*a*, 15*b* and 15*c* of a ridge 15 formed in the waveguide 11, the plane 15*a* parallel to the front surface 11*a* of the waveguide 11, and of a plurality of planes 55*a*, 55*b* and 55*c* of the ridge 55 formed in the waveguide 51, the plane 55*a* parallel to the front surface 51*a* of the waveguide 51 are in the same plane.

Namely, the plane 15*a* of the ridge 15 and the plane 55*a* of the ridge 55 are in a plane indicated by B of FIG. 11.

Next, operation will be described.

In the case in which the waveguide slot array antennas 10 and 50 are used as transmit antennas that transmit signals, signals to be transmitted are inputted, for example, from an end in the +x-direction or −x-direction of the waveguides 11 and 51.

The signals having been inputted from the end in the +x-direction or −x-direction of the waveguides 11 and 51 propagate in the cavities 14 and 54 of the waveguides 11 and 51.

The signals having propagated in the cavity 14 of the waveguide 11 are radiated to the outside through the slots 12*a* and 12*b* formed in the front surface 11*a* of the waveguide 11, as signals whose co-polarization is in the y-direction.

The signals having propagated in the cavity 54 of the waveguide 51 are radiated to the outside through the slots 52*a* and 52*b* formed in the front surface 51*a* of the waveguide 51, as signals whose co-polarization is in the y-direction.

In the case in which the waveguide slot array antennas 10 and 50 are used as receive antennas that receive signals, signals having arrived from the outside and having co-polarization in the y-direction enter through the slots 12*a* and 12*b* formed in the front surface 11*a* of the waveguide 11.

In addition, signals having arrived from the outside and having co-polarization in the y-direction enter through the slots 52*a* and 52*b* formed in the front surface 51*a* of the waveguide 51.

The signals having entered through the slots 12*a* and 12*b* propagate in the cavity 14 of the waveguide 11 and are outputted, for example, from the end in the +x-direction or −x-direction of the waveguide 11.

In addition, the signals having entered through the slots 52*a* and 52*b* propagate in the cavity 54 of the waveguide 51 and are outputted, for example, from the end in the +x-direction or −x-direction of the waveguide 51.

Although here an example is shown in which signals are inputted and outputted from the end in the +x-direction or −x-direction of the waveguides 11 and 51 of the waveguide slot array antennas 10 and 50, for example, signals may be inputted from or outputted to a waveguide connected to the bottoms of the waveguides 11 and 51.

In Embodiment 2, a signal to be transmitted or received by the waveguide slot array antennas 10 and a signal to be transmitted or received by the waveguide slot array antennas 50 are signals both having co-polarization in the y-direction.

Note, however, that in the example of FIGS. 10 and 11, since the dimension in the y-direction of the waveguides 11 of the waveguide slot array antennas 10 differs from the dimension in the y-direction of the waveguides 51 of the waveguide slot array antennas 50, the frequency band of signals to be transmitted or received by the waveguide slot array antennas 10 differs from the frequency band of signals to be transmitted or received by the waveguide slot array antennas 50.

Although in the example of FIGS. 10 and 11 the dimension in the y-direction of the waveguides 11 of the waveguide slot array antennas 10 differs from the dimension in the y-direction of the waveguides 51 of the waveguide slot array antennas 50, the dimension in the y-direction of the waveguides 11 of the waveguide slot array antennas 10 may be the same as the dimension in the y-direction of the waveguides 51 of the waveguide slot array antennas 50.

In this case, the frequency band of signals to be transmitted or received by the waveguide slot array antennas 10 is the same as the frequency band of signals to be transmitted or received by the waveguide slot array antennas 50, but the waveguide slot array antennas 10 and 50 may transmit or receive signals of different frequencies in the same frequency band.

In the waveguide slot array antennas 10 and 50, upon radiating a signal to the outside, grating lobes which are radiation of electromagnetic waves in undesired directions may occur.

Namely, in the waveguide slot array antennas 10, when the spacing between the plurality of waveguide slot array antennas 10 are one or more wavelengths of a signal whose co-polarization is in the y-direction and which is transmitted or received by the waveguide slot array antennas 10, grating lobes occur.

In addition, in the waveguide slot array antennas 50, when the spacing between the plurality of waveguide slot array antennas 50 are one or more wavelengths of a signal whose co-polarization is in the y-direction and which is transmitted or received by the waveguide slot array antennas 50, grating lobes occur.

Therefore, to suppress grating lobes occurring in the waveguide slot array antennas 10, the spacing between the plurality of waveguide slot array antennas 10 need to be less than one wavelength of a signal whose co-polarization is in the y-direction and which is transmitted or received by the waveguide slot array antennas 10.

In addition, to suppress grating lobes occurring in the waveguide slot array antennas 50, the spacing between the plurality of waveguide slot array antennas 50 need to be less than one wavelength of a signal whose co-polarization is in the y-direction and which is transmitted or received by the waveguide slot array antennas 50.

To set the spacing between the plurality of waveguide slot array antennas 10 and the spacing between the plurality of waveguide slot array antennas 50 to less than one wavelength of a signal, the dimensions in the y-direction which are the waveguide widths of the waveguide slot array antennas 10 and 50 need to be short.

The waveguides 11 and 51 of the waveguide slot array antennas 10 and 50 are ridge waveguides including the ridges 15 and 55 extending from the bottoms 14*a* and 54*a* of the cavities 14 and 54 to the side of the front surfaces 11*a* and 51*a* of the waveguides 11 and 51.

In the waveguides 11 and 51 which are ridge waveguides, the dimension in the y-direction which is a waveguide width can be reduced compared to a rectangular waveguide.

By the reduction in the dimensions in the y-direction of the waveguides 11 and 51, the spacing between the plurality of waveguide slot array antennas 10 may become less than one wavelength of a signal whose co-polarization is in the y-direction and which is transmitted or received by the waveguide slot array antennas 10.

In this case, the occurrence of grating lobes in the waveguide slot array antennas 10 can be suppressed.

In addition, by the reduction in the dimensions in the y-direction of the waveguides 11 and 51, the spacing between the plurality of waveguide slot array antennas 50 may become less than one wavelength of a signal whose co-polarization is in the y-direction and which is transmitted or received by the waveguide slot array antennas 50.

In this case, the occurrence of grating lobes in the waveguide slot array antennas 50 can be suppressed.

Note, however, that even if the dimensions in the y-direction of the waveguides 11 and 51 are reduced, the spacing between the plurality of waveguide slot array antennas 10 may become one or more wavelengths of a signal whose co-polarization is in the y-direction, depending on the wavelength of a signal whose co-polarization is in the y-direction and which is transmitted or received by the waveguide slot array antennas 10.

In this case, the occurrence of grating lobes in the waveguide slot array antennas 10 cannot be suppressed.

In addition, even if the dimensions in the y-direction of the waveguides 11 and 51 are reduced, the spacing between the plurality of waveguide slot array antennas 50 may become one or more wavelengths of a signal whose co-polarization is in the y-direction, depending on the wavelength of a signal whose co-polarization is in the y-direction and which is transmitted or received by the waveguide slot array antennas 50.

In this case, the occurrence of grating lobes in the waveguide slot array antennas 50 cannot be suppressed.

However, in the waveguides 11 and 51 which are ridge waveguides, since the dimensions in the y-direction of the cavities 14 and 54 can be reduced compared to a rectangular waveguide, the amount of grating lobes occurring can be reduced over a rectangular waveguide.

In addition, in the waveguides 11 and 51 which are ridge waveguides, by changing the shape or size of the ridges 15 and 55, the amount of reduction in cutoff frequency changes.

Hence, in the waveguides 11 and 51 which are ridge waveguides, by changing the shape or size of the ridges 15 and 55, the spacing between the plurality of waveguide slot array antennas 10 can be made less than one wavelength of a signal whose co-polarization is in the y-direction and which is transmitted or received by the waveguide slot array antennas 10. Likewise, the spacing between the plurality of waveguide slot array antenna 50 can be made less than one wavelength of a signal whose co-polarization is in the y-direction and which is transmitted or received by the waveguide slot array antenna 50.

When the spacing between the plurality of waveguide slot array antennas 10 can be made less than one wavelength of a signal whose co-polarization is in the y-direction and which is transmitted or received by the waveguide slot array antennas 10, a signal whose co-polarization is in the y-direction can be suppressed from being radiated in undesired directions.

In addition, when the spacing between the plurality of waveguide slot array antenna 50 can be made less than one wavelength of a signal whose co-polarization is in the y-direction and which is transmitted or received by the waveguide slot array antennas 10, a signal whose co-polarization is in the y-direction can be suppressed from being radiated in undesired directions.

As is clear from the above, according to Embodiment 2, it is configured such that there are provided the waveguide slot array antennas 10 each having the slots 12*a* and 12*b* that transmit or receive electromagnetic waves and that are formed in the front surface 11*a* of the waveguide 11 and the waveguide slot array antenna 50 each having the slots 52*a* and 52*b* that transmit or receive electromagnetic waves and that are formed in the front surface 51*a* of the waveguide 51, and the waveguide slot array antennas 10 and the waveguide slot array antenna 50 are alternately arranged, the waveguide 11 is a ridge waveguide having the ridge 15 formed inside the waveguide, and the waveguide 51 is a ridge waveguide having the ridge formed inside the waveguide, and thus, an advantageous effect is provided that an array antenna apparatus with smaller overall outer dimensions than one in which the waveguides 11 and 51 are rectangular waveguides can be obtained.

Note that when, by a reduction in the dimensions in the y-direction of the waveguides 11 and 51, the spacing between the plurality of waveguide slot array antennas 10 become less than one wavelength of a signal whose co-polarization is in the y-direction and which is transmitted or received by the waveguide slot array antennas 10 and the spacing between the plurality of waveguide slot array antenna 50 become less than one wavelength of a signal whose co-polarization is in the y-direction and which is transmitted or received by the waveguide slot array antenna 50, the occurrence of grating lobes can be suppressed.

A method for manufacturing an array antenna apparatus of Embodiment 2 will be described below.

As shown in FIG. 11, the array antenna apparatus includes a first member 31 and a second member 32.

In Embodiment 2, it is assumed that the array antenna apparatus is manufactured by processing each of the first member 31 and the second member 32 into shapes shown in FIG. 11, and then joining together the first member 31 and the second member 32.

Processing of the first member 31 will be described.

Here, it is assumed that a member obtained before processing the first member 31 (hereinafter, referred to as "original member P1") is a flat board.

By performing groove processing in which linear grooves whose longitudinal direction is the x-direction are made, on the front surfaces 11*a* of the waveguides 11 which are part of a front surface of the first member 31, the slots 12*a* and 12*b* are formed.

In addition, by performing groove processing in which linear grooves whose longitudinal direction is the x-direction are made, on the front surfaces 51*a* of the waveguides 51 which are part of the front surface of the first member 31, the slots 52*a* and 52*b* are formed.

A back surface of the first member 31 is provided with the cavities 14 and the cavities 54 and thus has portions recessed in the +z-direction with reference to the division plane B.

Hence, by partially milling a bottom side of the original member P1 as shown in FIG. 11, the cavities 14 of the waveguides 11 and the cavities 54 of the waveguides 51 are formed.

Here, an example is shown in which the cavities 14 of the waveguides 11 and the cavities 54 of the waveguides 51 are hollow insulators.

In addition, although here an example is shown in which processing of the front-surface side of the first member 31 is performed and then processing of the back-surface side of the first member 31 is performed, processing of the back-surface side of the first member 31 may be performed and then processing of the front-surface side of the first member 31 may be performed.

Processing of the second member 32 will be described.

A front surface of the second member 32 is provided with the cavities 14 and the cavities 54 and thus has portions recessed in the −z-direction with reference to the division plane B.

Hence, for example, when a member obtained before processing the second member 32 (hereinafter, referred to as "original member P2") is a flat board, by partially milling a top side of the original member P2 as shown in FIG. 11, the cavities 14 of the waveguides 11 and the cavities 54 of the waveguides 51 are formed.

Then, by performing surface grinding processing in which a plane is ground, on the top side of the original member P2 whose top side has been partially cut, the planes 15*a* of the ridges 15 and the planes 55*a* of the ridges 55 are processed.

Since the surface grinding processing can use a surface grinding machine with a large processing area and the like, the planes 15*a* of the ridges 15 and the planes 55*a* of the ridges 55 can be easily processed.

Namely, by using a surface grinding machine with a large processing area and the like, the planes 15*a* of the ridges 15 and the planes 55*a* of the ridges 55 can be simultaneously processed, and thus, processing time can be reduced.

Although here an example is shown in which processing of the first member 31 is performed and then processing of the second member 32 is performed, processing of the second member 32 may be performed and then processing of the first member 31 may be performed.

When processing of the first member 31 and the second member 32 has been performed, the first member 31 and the second member 32 are joined together.

For a method for joining together the first member 31 and the second member 32, for example, a method for bonding using a conductive adhesive is considered. There is only one joint surface between the first member 31 and the second member 32.

Hence, when the first member 31 and the second member 32 are joined together using a conductive adhesive, only by applying pressure to the first member 31 and the second member 32 in one direction, i.e., the z-direction, the first member 31 and the second member 32 can be joined together.

Although here a method for joining together the first member 31 and the second member 32 using a conductive adhesive is shown, the method is not limited to one using a conductive adhesive and, for example, the first member 31 and the second member 32 may be joined together by a method such as diffusion bonding, brazing, or screwing. Even in a case of joining by screwing, by performing screwing in which a screw is inserted in the z-direction, conduction between the first member 31 and the second member 32 can be obtained.

Embodiment 2 shows that the division plane B between the first member 31 and the second member 32 is the planes 15*a* of the ridges 15 of the waveguides 11 and the planes 55*a* of the ridges 55 of the waveguides 51.

This facilitates processing of the back-surface side of the first member 31 and facilitates processing of the front-surface side of the second member 32.

As is clear from the above, according to Embodiment 2, it is configured such that upon manufacturing an array antenna apparatus in which the planes 15*a* of the ridges 15 of the waveguides 11 and the planes 55*a* of the ridges 55 of the waveguides 51 are in the same plane, the array antenna apparatus is manufactured by joining together the first member 31 and the second member 32 into which the array antenna apparatus is divided in the z-direction, and the division plane B between the first member 31 and the second member 32 is the planes 15*a* of the ridges 15 of the waveguides 11 and the planes 55*a* of the ridges 55 of the waveguides 51, and thus, the array antenna apparatus can be easily manufactured and a reduction in yield due to joint failure can be prevented.

Embodiment 3

The above-described Embodiment 1 describes an array antenna apparatus including the waveguide slot array antennas 10 that transmit or receive signals whose co-polarization is in the y-direction; and the waveguide slot array antennas 20 that transmit or receive signals whose co-polarization is in the x-direction.

This Embodiment 3 describes an array antenna apparatus including waveguide slot array antenna 60 that transmit or receive signals whose co-polarization is in the x-direction; and waveguide slot array antennas 20 that transmit or receive signals whose co-polarization is in the x-direction.

Figure 12:
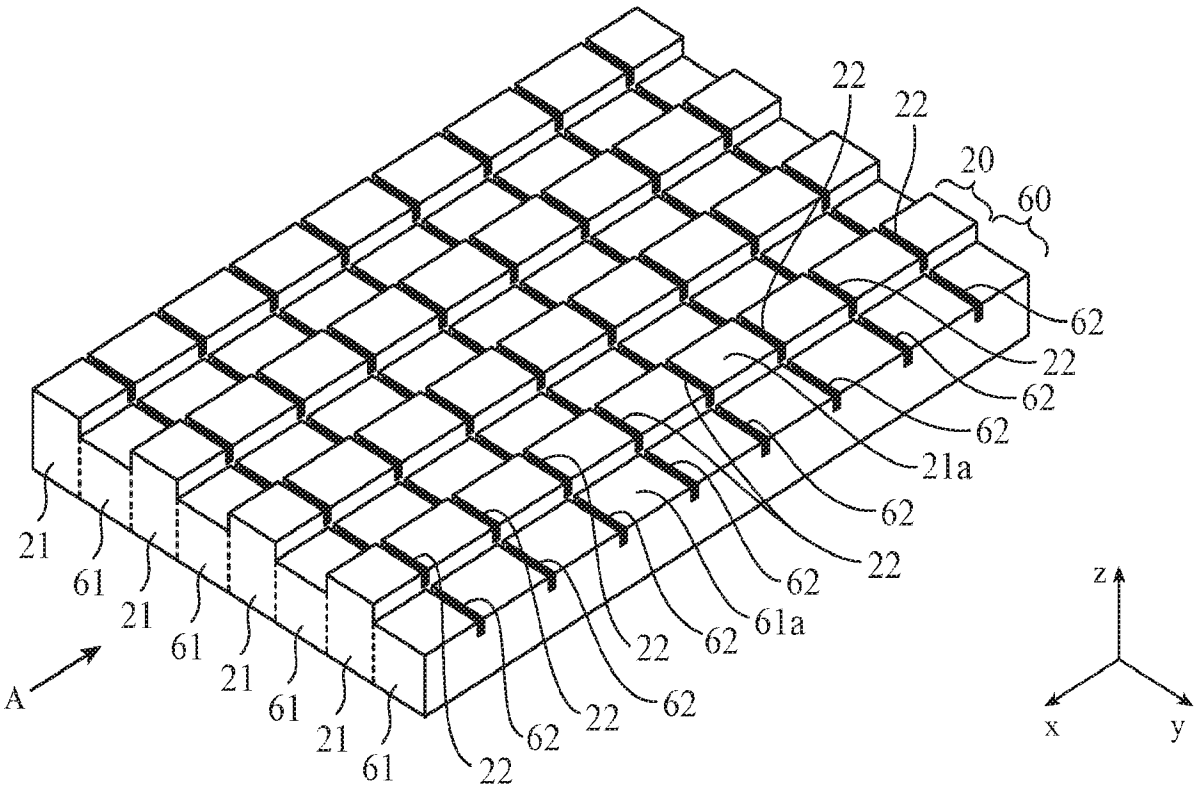
FIG. 12 is a perspective view showing an array antenna apparatus according to Embodiment 3 of this disclosure.
Figure 13:
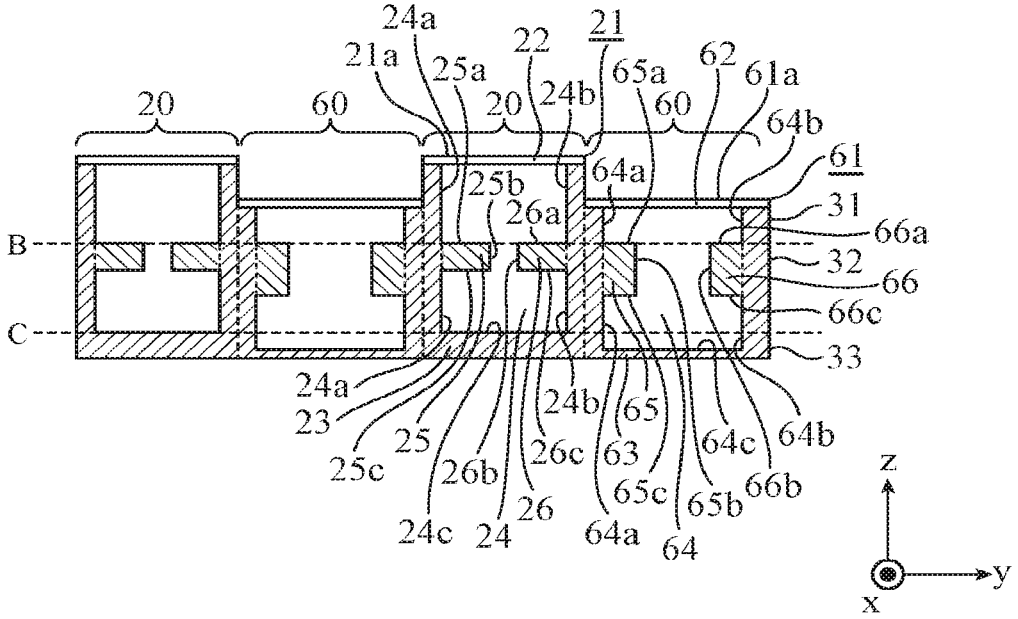
FIG. 13 is a cross-sectional transparent view showing the array antenna apparatus as viewed from A of FIG. 12.

FIG. 12 is a perspective view showing an array antenna apparatus according to Embodiment 3 of the disclosure, and FIG. 13 is a cross-sectional transparent view showing the array antenna apparatus as viewed from A of FIG. 12.

In FIGS. 12 and 13, the same reference signs as those of FIGS. 1 and 2 denote the same or corresponding portions and thus description thereof is omitted.

FIG. 13 shows an example in which, for simplification of the drawing, two waveguide slot array antenna 60 and two waveguide slot array antennas 20 are arranged.

The waveguide slot array antenna 60 are first antennas each having slots 62 that transmit or receive signals (electromagnetic waves) whose co-polarization is in the x-direction and that are formed in a front surface 61*a* of a waveguide 61.

The waveguide 61 which is a first waveguide has an outer wall 63 which is a conductor such as a metal, and has a cavity 64 which is the inside and is, for example, a hollow or dielectric insulator.

Note that, for the outer wall 63 of the waveguide 61, aluminum is commonly used, but any other metals than aluminum, and the like, may be used as long as it works as a conductor for the radio frequencies of signals to be transmitted or received.

The slots 62 which are first slots are openings provided in the front surface 611*a* of the waveguide 61 to transmit or receive signals whose co-polarization is in the x-direction, and a longitudinal direction of the openings is the y-direction.

A ridge 65 is a first protrusion extending from a side part 64*a* of the cavity 64 of the waveguide 61 to the side of a side part 64*b*.

A ridge 66 is a first protrusion extending from the side part 64*b* of the cavity 64 of the waveguide 61 to the side of the side part 64*a*.

Therefore, the waveguide 61 of the waveguide slot array antenna 60 is a ridge waveguide having the first protrusions formed inside the waveguide.

In Embodiment 3, of a plurality of planes 65*a*, 65*b* and 65*c* of the ridge 65 formed in the waveguide 61, the plane 65*a* parallel to the front surface 61*a* of the waveguide 61, of a plurality of planes 66*a*, 66*b* and 66*c* of the ridge 66 formed in the waveguide 61, the plane 66*a* parallel to the front surface 61*a* of the waveguide 61, of a plurality of planes 25*a*, 25*b* and 25*c* of the ridge 25 formed in the waveguide 21, the plane 25*a* parallel to the front surface 21*a* of the waveguide 21, and of a plurality of planes 26*a*, 26*b* and 26*c* of the ridge 26 formed in the waveguide 21, the plane 26*a* parallel to the front surface 21*a* of the waveguide 21 are in the same plane.

Namely, the planes 65*a* and 66*a* of the ridges 65 and 66 and the planes 25*a* and 26*a* of the ridges 25 and 26 are in a plane indicated by B of FIG. 13.

Note that since the planes 65*c* and 66*c* of the ridges 65 and 66 are also planes parallel to the front surface 61*a* of the waveguide 61, the planes 65*c* and 66*c* may be in the plane indicated by B of FIG. 13. Likewise, since the planes 25*c* and 26*c* of the ridges 25 and 26 are also planes parallel to the front surface 21*a* of the waveguide 21, the planes 25*c* and 26*c* may be in the plane indicated by B of FIG. 13.

However, in Embodiment 3, the planes 65*a*, 66*a*, 25*a*, and 26*a* are in the plane indicated by B of FIG. 13 because processing of the first member 31 which will be described later is easier with the planes 65*a*, 66*a*, 25*a*, and 26*a* being in the plane indicated by B of FIG. 13.

Next, operation will be described.

In the case in which the waveguide slot array antennas 60 and 20 are used as transmit antennas that transmit signals, signals to be transmitted are inputted, for example, from an end in the +x-direction or −x-direction of the waveguides 61 and 21.

The signals having been inputted from the end in the +x-direction or −x-direction of the waveguides 61 and 21 propagate in the cavities 64 and 24 of the waveguides 61 and 21.

The signals having propagated in the cavity 64 of the waveguide 61 are radiated to the outside through the slots 62 formed in the front surface 61*a* of the waveguide 61, as signals whose co-polarization is in the x-direction.

In addition, the signals having propagated in the cavity 24 of the waveguide 21 are radiated to the outside through the slots 22 formed in the front surface 21*a* of the waveguide 21, as signals whose co-polarization is in the x-direction.

In the case in which the waveguide slot array antennas 60 and 20 are used as receive antennas that receive signals, signals having arrived from the outside and having co-polarization in the x-direction enter through the slots 62 formed in the front surface 61*a* of the waveguide 61.

In addition, signals having arrived from the outside and having co-polarization in the x-direction enter through the slots 22 formed in the front surface 21*a* of the waveguide 21.

The signals having entered through the slots 62 propagate in the cavity 64 of the waveguide 61 and are outputted, for example, from the end in the +x-direction or −x-direction of the waveguide 61.

In addition, the signals having entered through the slots 22 propagate in the cavity 24 of the waveguide 21 and are outputted, for example, from the end in the +x-direction or −x-direction of the waveguide 21.

Although here an example is shown in which signals are inputted and outputted from the end in the +x-direction or −x-direction of the waveguides 61 and 21 of the waveguide slot array antennas 60 and 20, for example, signals may be inputted from or outputted to a waveguide connected to the bottoms of the waveguides 61 and 21.

In Embodiment 3, a signal to be transmitted or received by the waveguide slot array antenna 60 and a signal to be transmitted or received by the waveguide slot array antennas 20 are signals both having co-polarization in the x-direction.

Note, however, that in the example of FIGS. 12 and 13, since the dimension in the z-direction of the waveguides 61 of the waveguide slot array antenna 60 differs from the dimension in the z-direction of the waveguides 21 of the waveguide slot array antennas 20, the frequency band of signals to be transmitted or received by the waveguide slot array antenna 60 differs from the frequency band of signals to be transmitted or received by the waveguide slot array antennas 20.

Although in the example of FIGS. 12 and 13 the dimension in the z-direction of the waveguides 61 of the waveguide slot array antenna 60 differs from the dimension in the z-direction of the waveguides 21 of the waveguide slot array antennas 20, the dimension in the z-direction of the waveguides 61 of the waveguide slot array antenna 60 may be the same as the dimension in the z-direction of the waveguides 21 of the waveguide slot array antennas 20.

In this case, the frequency band of signals to be transmitted or received by the waveguide slot array antenna is the same as the frequency band of signals to be transmitted or received by the waveguide slot array antennas 20, but the waveguide slot array antennas 60 and 20 may transmit or receive signals of different frequencies in the same frequency band.

The slots 62 and 22 whose longitudinal directions are the y-direction are formed in the front surfaces 61*a* and 21*a* of the waveguides 61 and 21 of the waveguide slot array antennas 60 and 20 so as to transmit or receive signals whose co-polarization is in the x-direction.

Hence, if the waveguides 61 and 21 are rectangular waveguides, the cross-sectional shapes of the cavities 64 and 24 of the waveguides 61 and 21 are rectangles whose longitudinal direction is the z-direction and whose transverse direction is the y-direction.

Here, it is known that the waveguides 61 and 21 which are ridge waveguides have a lower cutoff frequency of a signal to be transmitted or received than a rectangular waveguide.

Therefore, in the waveguides 61 and 21 which are ridge waveguides, the dimensions in the z-direction of the cavities 64 and 24 can be reduced compared to a rectangular waveguide. When the dimensions in the z-direction of the cavities 64 and 24 can be reduced, the dimensions in the z-direction which are the waveguide heights of the waveguides 61 and 21 can be reduced.

By the reduction in the dimensions in the z-direction of the cavities 64 and 24 of the waveguides 61 and 21, the dimension in the z-direction of the array antenna apparatus is reduced, enabling reduction of the thickness of the array antenna apparatus.

Although in the example of FIG. 13 the two ridges 65 and 66 are symmetrically provided to improve the symmetry of a structure in the y-direction of the waveguide 61, only one of the ridges 65 and 66 may be provided.

Likewise, although the two ridges 25 and 26 are symmetrically provided to improve the symmetry of a structure in the y-direction of the waveguide 21, only one of the ridges 25 and 26 may be provided.

As is clear from the above, according to Embodiment 3, it is configured such that there are provided the waveguide slot array antenna 60 each having the slots 62 that transmit or receive electromagnetic waves and that are formed in the front surface 61*a* of a waveguide 61 and the waveguide slot array antennas 20 each having the slots 22 that transmit or receive electromagnetic waves and that are formed in the front surface 21*a* of the waveguide 21, and the waveguide slot array antenna 60 and the waveguide slot array antennas 20 are alternately arranged, the waveguide 61 is a ridge waveguide having the ridges 65 and 66 formed inside the waveguide, and the waveguide 21 is a ridge waveguide having the ridges 25 and 26 formed inside the waveguide, and thus, an advantageous effect is provided that an array antenna apparatus with smaller overall outer dimensions than one in which the waveguides 61 and 21 are rectangular waveguides can be obtained. Namely, an advantageous effect of being able to obtain a thin array antenna apparatus is provided.

A method for manufacturing an array antenna apparatus of Embodiment 3 will be described below.

As shown in FIG. 13, the array antenna apparatus includes the first member 31, the second member 32, and the third member 33.

In Embodiment 3, it is assumed that the array antenna apparatus is manufactured by processing each of the first member 31, the second member 32, and the third member 33 into shapes shown in FIG. 13, and then joining together the first member 31, the second member 32, and the third member 33.

Processing of the first member 31 will be described.

A front surface of the first member 31 has portions recessed in the −z-direction with reference to the front surfaces 21*a* of the waveguides 21. Namely, the front surfaces 61*a* of the waveguides 61 are recessed in the −z-direction relative to the front surfaces 21*a* of the waveguides 21.

Hence, for example, when a member obtained before processing the first member 31 (hereinafter, referred to as "original member P1") is a flat board, by partially milling a top side of the original member P1 as shown in FIG. 13, the front surfaces 61*a* of the waveguides 61 are formed.

Then, by performing groove processing in which linear grooves whose longitudinal direction is the y-direction are made, on the front surfaces 61*a* of the waveguides 61, the slots 62 are formed.

In addition, by performing groove processing in which linear grooves whose longitudinal direction is the y-direction are made, on the front surfaces 21*a* of the waveguides 21, slots 22 are formed.

A back surface of the first member 31 is provided with the cavities 64 and the cavities 24 and thus has portions recessed in the +z-direction with reference to the division plane B.

Hence, by partially milling a bottom side of the original member P1 as shown in FIG. 13, the cavities 64 of the waveguides 61 and the cavities 24 of the waveguides 21 are formed. Here, an example is shown in which the cavities of the waveguides 61 and the cavities 24 of the waveguides 21 are hollow insulators.

Note, however, that when irises are provided in the cavities 64 and 24 of the waveguides 61 and 21, upon forming the cavities 64 and 24 of the waveguides 61 and 21 by partially milling the bottom side of the original member P1, the bottom side of the original member P1 is cut such that irises remain.

Although here an example is shown in which processing of the front-surface side of the first member 31 is performed and then processing of the back-surface side of the first member 31 is performed, processing of the back-surface side of the first member 31 may be performed and then processing of the front-surface side of the first member 31 may be performed.

Processing of the second member 32 will be described.

A front surface of the second member 32 is provided with the cavities 64 and the cavities 24 and thus has portions recessed in the −z-direction with reference to the division plane B.

Hence, for example, when a member obtained before processing the second member 32 (hereinafter, referred to as "original member P2") is a flat board, by partially milling a top side of the original member P2 as shown in FIG. 13, part of cavities 64 of the waveguides 61 is formed and part of cavities 24 of the waveguides 21 is formed.

In the example of FIG. 13, the cross-sectional shapes of the cavities 64 and 24 of the waveguides 61 and 21 are such shapes that the alphabet "H" is turned sideways.

Hence, the cross-sectional shapes of the cavities 64 and 24 of the second member 32 are such shapes that a lower rectangular portion with a wide width in the y-direction and an upper rectangular portion with a narrow width in the y-direction are stacked on top of each other.

Processing of the upper rectangular portions with a narrow width in the y-direction in the cavities 64 and 24 can be easily performed by milling from the front-surface side of the second member 32, but processing of the lower rectangular portions with a wide width in the y-direction in the cavities 64 and 24 is more easily performed by milling from the back-surface side of the second member 32 than by milling from the front-surface side of the second member 32.

Hence, here, only processing of the upper rectangular portions with a narrow width in the y-direction in the cavities 64 and 24 is performed.

Then, by performing surface grinding processing in which a plane is ground, on the top side of the original member P2 whose top side has been partially cut, the planes 65*a* and 66*a* of the ridges 65 and 66 and the planes 25*a* and 26*a* of the ridges 25 and 26 are processed.

Since the surface grinding processing can use a surface grinding machine with a large processing area and the like, the planes 65*a* and 66*a* of the ridges 65 and 66 and the planes 25*a* and 26*a* of the ridges 25 and 26 can be easily processed.

Namely, by using a surface grinding machine with a large processing area and the like, the planes 65*a* and 66*a* of the ridges 65 and 66 and the planes 25*a* and 26*a* of the ridges 25 and 26 can be simultaneously processed, and thus, processing time can be reduced.

A back surface of the second member 32 is provided with the cavities 64 and 24 of the waveguides 61 and 21 and thus has portions recessed in the +z-direction with reference to a division plane C.

Hence, by partially milling a bottom side of the original member P2 as shown in FIG. 13, the cavities 64 and 24 of the waveguides 61 and 21 are formed.

Since processing of the upper rectangular portions with a narrow width in the y-direction in the cavities 64 and 24 has already been performed, only processing of the lower rectangular portions with a wide width in the y-direction in the cavities 64 and 24 is performed.

Although here an example is shown in which processing of the front-surface side of the second member 32 is performed and then processing of the back-surface side of the second member 32 is performed, processing of the back-surface side of the second member 32 may be performed and then processing of the front-surface side of the second member 32 may be performed.

Processing of the third member 33 will be described.

A front surface of the third member 33 is provided with the cavities 64 and thus has portions recessed in the −z-direction with reference to the division plane C.

Hence, for example, when a member obtained before processing the third member 33 (hereinafter, referred to as "original member P3") is a flat board, by partially milling a top side of the original member P3 as shown in FIG. 13, the cavities 64 of the waveguides 61 are formed.

Although here processing is performed in the order of the first member 31, the second member 32, and the third member 33, the processing order of the first member 31, the second member 32, and the third member 33 may be any, and for example, processing may be performed in the order of the third member 33, the second member 32, and the first member 31.

When processing of the first member 31, the second member 32, and the third member 33 has been performed, the first member 31 and the second member 32 are joined together, and the second member 32 and the third member 33 are joined together.

For a method for joining together the first member 31 and the second member 32 and a method for joining together the second member 32 and the third member 33, for example, a method for bonding using a conductive adhesive is considered.

There is only one joint surface between the first member 31 and the second member 32, and there is only one joint surface between the second member 32 and the third member 33.

Hence, when the first member 31 to the third member 33 are joined together using a conductive adhesive, only by applying pressure to the first member 31 to the third member 33 in one direction, i.e., the z-direction, the first member 31 to the third member 33 can be joined together.

Although here a method for joining together the first member 31 to the third member 33 using a conductive adhesive is shown, the method is not limited to one using a conductive adhesive and, for example, the first member 31 to the third member 33 may be joined together by a method such as diffusion bonding, brazing, or screwing. Even in a case of joining by screwing, by performing screwing in which a screw is inserted in the z-direction, conduction between the first member 31 to the third member 33 can be obtained.

Embodiment 3 shows that the division plane B between the first member 31 and the second member 32 is the planes 65*a* and 66*a* of the ridges 65 and 66 of the waveguides 61 and the planes 25*a* and 26*a* of the ridges 25 and 26 of the waveguides 21. This facilitates processing of the back-surface side of the first member 31 and facilitates processing of the front-surface side of the second member 32.

In addition, Embodiment 3 shows that the division plane C between the second member 32 and the third member 33 is in the position of the bottoms 24*c* of the cavities 24 of the waveguides 21. This facilitates processing of the back-surface side of the second member 32.

As is clear from the above, according to Embodiment 3, it is configured such that upon manufacturing the array antenna apparatus in which the planes 65*a* and 66*a* of the ridges 65 and 66 of the waveguides 61 and the planes 25*a* and 26*a* of the ridges 25 and 26 of the waveguides 21 are in the same plane, the array antenna apparatus is manufactured by joining together the first member 31 and the second member 32 into which the array antenna apparatus is divided in the z-direction, and the division plane B between the first member 31 and the second member 32 is the planes 65*a* and 66*a* of the ridges 65 and 66 of the waveguides 61 and the planes 25*a* and 26*a* of the ridges 25 and 26 of the waveguides 21, and thus, the array antenna apparatus can be easily manufactured and a reduction in yield due to joint failure can be prevented.

Although Embodiment 3 shows that the division plane C between the second member 32 and the third member 33 is the bottoms 24*c* of the cavities 24 of the waveguides 21, the division plane C between the second member 32 and the third member 33 may be bottoms 64*c* of the cavities 64 of the waveguides 61.

In addition, the division plane C between the second member 32 and the third member 33 may be in a position between the bottoms 64*c* of the cavities 64 of the waveguides 61 and the bottoms 24*c* of the cavities 24 of the waveguides 21.

In addition, although Embodiment 3 shows that the bottoms 64*c* of the cavities 64 of the waveguides 61 are provided in a more −z-direction position than the bottoms 24*c* of the cavities 24 of the waveguides 21, the bottoms 64*c* of the cavities 64 of the waveguides 61 may be provided in a more +z-direction position than the bottoms 24*c* of the cavities 24 of the waveguides 21.

Note that, a free combination of the embodiments, modifications to any component of the embodiments, or omissions of any component in the embodiments are possible within the scope of the invention.

INDUSTRIAL APPLICABILITY

Disclosed array antenna apparatuses are suitable for use as an array antenna apparatus having slots, formed in front surfaces of waveguides, for transmitting or receiving electromagnetic waves.

In addition, disclosed methods are suitable for use as a method for manufacturing an array antenna apparatus having slots, formed in front surfaces of waveguides, for transmitting or receiving electromagnetic waves.

REFERENCE SIGNS LIST

10: Waveguide slot array antenna (first antenna); 11: Waveguide (first waveguide); 11*a*: Front surface of the waveguide 11; 11*b*: Back surface of the waveguide 11; 12*a* and 12*b*: Slot (first slot); 13: Outer wall of the waveguide 11; 14: Cavity of the waveguide 11; 14*a*: Bottom of the cavity 14; 15: Ridge (first protrusion); 15*a*, 15*b* and 15*c*: Plane of the ridge 15; 20: Waveguide slot array antenna (second antenna); 21: Waveguide (second waveguide); 21*a*: Front surface of the waveguide 21; 21*b*: Back surface of the waveguide 21; 22: Slot (second slot); 23: Outer wall of the waveguide 21; 24*a* and 24*b*: Side part of the cavity 24; 24*c*: Bottom of the cavity 24; 25 and 26: Ridge (second protrusion); 25*a*, 25*b* and 25*c*: Plane of the ridge 25; 26*a*, 26*b* and 26*c*: Plane of the ridge 26; 31: First member; 32: Second member; 33: Third member; 40: Iris; 50: Waveguide slot array antenna (second antenna); 51: Waveguide (second waveguide); 51*a*: Front surface of the waveguide 51; 52*a* and 52*b*: Slot (second slot), 53: Outer wall of the waveguide 51, 54: Cavity of the waveguide 51; 54*a*: Bottom of the cavity 54; 55: Ridge (second protrusion); 55*a*, 55*b* and 55*c*: Plane of the ridge; 61: Waveguide (first waveguide); 61*a*: Front surface of the waveguide 61; 62: Slot (first slot); 63: Outer wall of the waveguide 61; 64*a* and 64*b*: Side part of the cavity 64; 64*c*: Bottom of the cavity 64; 65 and 66: Ridge (first protrusion); 65*a*, 65*b* and 65*c*: Plane of the ridge 65; and 66*a*, 66*b* and 66*c*: Plane of the ridge 66.

The invention claimed is:

1. An array antenna apparatus, comprising:

a first antenna including a first waveguide with a first slot for transmitting or receiving an electromagnetic wave, the first slot being formed in a front surface of the first waveguide; and a second antenna including a second waveguide with a second slot for transmitting or receiving an electromagnetic wave, the second slot being formed in a front surface of the second waveguide, wherein the first antenna and the second antenna are alternately arranged, the first waveguide is a ridge waveguide having a first protrusion formed inside, the second waveguide is a ridge waveguide having a second protrusion formed inside, and of surfaces of the first protrusion, a plane parallel to the front surface of the first waveguide and, of surfaces of the second protrusion, a plane parallel to the front surface of the second waveguide are in a same plane, wherein the first slot is an opening whose longitudinal direction is in waveguide axial direction of the first waveguide, the second slot is an opening whose longitudinal direction is in waveguide width direction of the second waveguide, the first protrusion is a protrusion extending from a bottom of a cavity of the first waveguide toward the front surface of the first waveguide, and the second protrusion is a protrusion extending from a side part of a cavity of the second waveguide toward an opposite side part.

2. An array antenna apparatus, comprising:

a first antenna comprising a first waveguide with a first slot for transmitting or receiving an electromagnetic wave, the first slot being formed in a front surface of the first waveguide; and a second antenna comprising a second waveguide with a second slot for transmitting or receiving an electromagnetic wave, the second slot being formed in a front surface of the second waveguide, wherein the first antenna and the second antenna are alternately arranged, the first waveguide is a ridge waveguide having a first protrusion formed inside, the second waveguide is a ridge waveguide having a second protrusion formed inside, and a dimension in a waveguide width direction of the first waveguide differs from a dimension in a waveguide width direction of the second waveguide, wherein of surfaces of the first protrusion, a plane parallel to the front surface of the first waveguide and, of surfaces of the second protrusion, a plane parallel to the front surface of the second waveguide are in a same plane, wherein the first slot is an opening whose longitudinal direction is a waveguide axial direction of the first waveguide, the second slot is an opening whose longitudinal direction is a waveguide axial direction of the second waveguide, the first protrusion is a protrusion extending from a bottom of a cavity of the first waveguide toward the front surface of the first waveguide, and the second protrusion is a protrusion extending from a bottom of a cavity of the second waveguide toward the front surface of the second waveguide.

3. An array antenna apparatus, comprising:

a first antenna comprising a first waveguide with a first slot for transmitting or receiving an electromagnetic wave, the first slot being formed in a front surface of the first waveguide; and a second antenna comprising a second waveguide with a second slot for transmitting or receiving an electromagnetic wave, the second slot being formed in a front surface of the second waveguide, wherein the first antenna and the second antenna are alternately arranged, the first waveguide is a ridge waveguide having a first protrusion formed inside, the second waveguide is a ridge waveguide having a second protrusion formed inside, and a dimension in a height direction of the first waveguide differs from a dimension in a height direction of the second waveguide, wherein of surfaces of the first protrusion, a plane parallel to the front surface of the first waveguide and, of surfaces of the second protrusion, a plane parallel to the front surface of the second waveguide are in a same plane, wherein the first slot is an opening whose longitudinal direction is a waveguide width direction of the first waveguide, the second slot is an opening whose longitudinal direction is a waveguide width direction of the second waveguide, the first protrusion is a protrusion extending from a side part of a cavity of the first waveguide toward an opposite side part, and the second protrusion is a protrusion extending from a side part of a cavity of the second waveguide toward an opposite side part.

4. The array antenna apparatus according to claim 1, wherein a dimension in a height direction of the first waveguide differs from a dimension in a height direction of the second waveguide.

* * * * *